US007240981B2

(12) United States Patent
Wade et al.

(10) Patent No.: US 7,240,981 B2
(45) Date of Patent: Jul. 10, 2007

(54) WIDE ARRAY FLUID EJECTION DEVICE

(75) Inventors: John Wade, Ramona, CA (US); George C. Lysy, San Diego, CA (US); Tom Dragnes, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 254 days.

(21) Appl. No.: 10/788,808

(22) Filed: Feb. 27, 2004

(65) Prior Publication Data

US 2005/0190217 A1 Sep. 1, 2005

(51) Int. Cl.
*B41J 29/38* (2006.01)

(52) U.S. Cl. ..... 347/12; 347/13; 347/48; 347/9

(58) Field of Classification Search ..... 347/12, 347/13

See application file for complete search history.

(56) References Cited

U.S. PATENT DOCUMENTS

| | | | | |
|---|---|---|---|---|
| 4,400,709 | A | 8/1983 | de Kermadec et al. | |
| 4,449,137 | A | 5/1984 | Inui et al. | |
| 4,710,783 | A | 12/1987 | Caine et al. | |
| 4,838,157 | A | 6/1989 | Signore, II | |
| 5,083,137 | A | 1/1992 | Badyal et al. | |
| 5,541,629 | A * | 7/1996 | Saunders et al. | 347/12 |
| 6,183,056 | B1 | 2/2001 | Corrigan et al. | |
| 6,215,513 | B1 | 4/2001 | Ashikaga | |
| 6,224,195 | B1 | 5/2001 | Maru et al. | |
| 6,302,507 | B1 | 10/2001 | Prakash et al. | |
| 6,309,040 | B1 * | 10/2001 | Norton | 347/9 |
| 6,315,381 | B1 | 11/2001 | Wade et al. | |
| 6,334,660 | B1 | 1/2002 | Holstun et al. | |
| 6,361,153 | B1 | 3/2002 | Wafler | |
| 6,471,320 | B2 * | 10/2002 | Anderson | 347/12 |
| 6,478,396 | B1 | 11/2002 | Schloeman et al. | |
| 6,517,195 | B1 | 2/2003 | Koeda | |
| 6,523,922 | B2 | 2/2003 | Hirayama | |
| 6,607,257 | B2 | 8/2003 | Szumla et al. | |
| 6,659,581 | B2 | 12/2003 | Schloeman et al. | |
| 6,712,451 | B2 | 3/2004 | Madziarz et al. | |
| 2002/0027574 | A1 | 3/2002 | Kao et al. | |
| 2002/0093544 | A1 | 7/2002 | Schloeman et al. | |
| 2002/0104751 | A1 | 8/2002 | McElfresh et al. | |
| 2002/0126168 | A1 | 9/2002 | Anderson | |
| 2003/0197748 | A1 | 10/2003 | Torgerson et al. | |
| 2003/0202024 | A1 | 10/2003 | Corrigan | |

FOREIGN PATENT DOCUMENTS

WO 2005/004989 2/2005

OTHER PUBLICATIONS

Search Report Feb. 16, 2005 Hewlett-Packard.

* cited by examiner

*Primary Examiner*—Matthew Luu
*Assistant Examiner*—Brian J. Goldberg

(57) ABSTRACT

A fluid ejection device includes a first set of N memory elements each storing a fire enable value, each of the N memory elements configured to be updated. The fluid ejection device further includes N fluid ejecting elements, each fluid ejecting element corresponding to a different one of the N memory elements and configured to receive the fire enable value from the corresponding memory element, wherein the fluid ejecting element is enabled to eject a fluid when the fire enable value is an enabling value.

23 Claims, 18 Drawing Sheets

WIDE ARRAY FLUID EJECTION DEVICE

BACKGROUND

An inkjet printing system, as one embodiment of a fluid ejection system, may include a printhead assembly, an ink supply which supplies liquid ink to the printhead assembly, and a controller which controls the printhead assembly. The printhead assembly, as one embodiment of a fluid ejection device, ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead assembly and the print medium are moved relative to each other.

Typically, the printhead assembly ejects the ink drops through the nozzles by rapidly heating a small volume of ink located in vaporization chambers with small electric heaters, such as thin film resistors, often referred to as firing resistors. Heating the ink causes the ink to vaporize and be ejected from the nozzles. Typically, for one dot of ink, a remote printhead assembly controller typically located as part of the processing electronics of a printer, controls activation of an electrical current from a power supply external to the printhead assembly. The electrical current is passed through a selected firing resistor to heat the ink in a corresponding selected vaporization chamber. The combination of a nozzle, a vaporization chamber, and a firing resistor is herein referred to as a drop generator.

One method of controlling the application of the electrical current through the selected firing resistor is to couple a switching device, such as a field effect transistor (FET), to each firing resistor. In one printhead arrangement, the firing resistors are grouped together in primitives, with a single power lead providing power to the source or drain of each FET for each firing resistor in a primitive. Each FET in a primitive has a separately energizable address lead coupled to its gate, with each address lead coupled to its gate, with each address lead shared by multiple primitives. In a typical printing operation, the address leads are controlled so that only a single firing resistor in a primitive is activated at a given time.

In one arrangement, the address lead coupled to the gate of each FET is controlled by a combination of nozzle data, nozzle addresses, and a fire pulse. The nozzle data is typically provided by the controller of the printer and represents the actual data to be printed. The fire pulse controls the timing of the activation of the electrical current through the selected firing resistor. Typical conventional inkjet printing systems employ the controller to control the timing related to the fire pulse. The nozzle address is cycled through all nozzle addresses to control the nozzle firing order so that all nozzles can be fired, but only a single nozzle in a primitive is fired at a given time.

While such arrangements are effective in controlling nozzle firing, connections between the printhead assembly and remote elements and between elements on the printhead assembly itself can become complex, especially as the number of nozzles and the area of the printhead assembly increase. An example of one such system is a wide-array inkjet printing system. Printing systems, particularly wide-array inkjet printing systems, would benefit from a simplified nozzle firing activation scheme.

DETAILED DESCRIPTION

In the following Detailed Description, reference is made to the accompanying drawings which form a part hereof, and in which is shown by way of illustration specific embodiments in which the invention may be practiced. In this regard, directional terminology, such as "top," "bottom," "row," "column," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
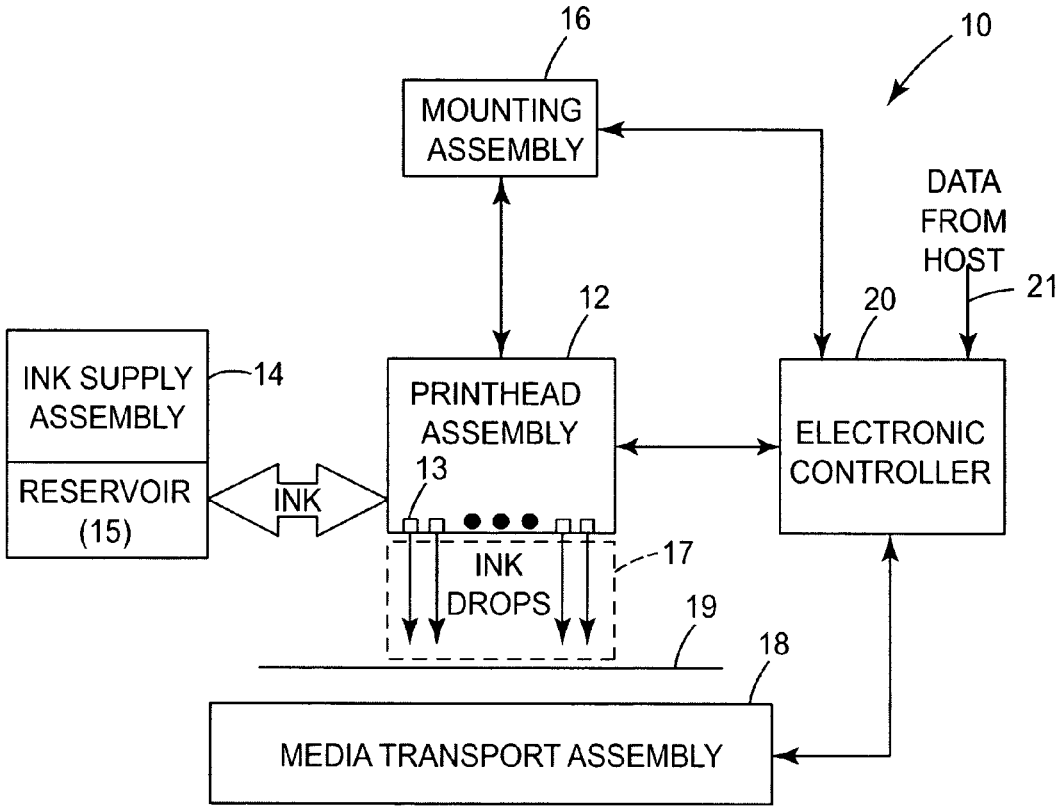
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection assembly, such as a printhead assembly 12, and a fluid supply assembly, such as an ink supply assembly 14. In the illustrated embodiment, inkjet printing system 10 also includes a mounting assembly 16, a media transport assembly 18, and a controller 20.

Printhead assembly 12, as one embodiment of a fluid ejection device, may be formed according to an embodiment of the present invention and ejects drops of ink, including one or more colored inks or UV readable inks, through a plurality of orifices or nozzles 13. While the following description refers to the ejection of ink from printhead assembly 12, it is understood that other liquids, fluids, or flowable materials, including clear fluid, may be ejected from printhead assembly 12. The types of fluids used will depend on the application for which the fluid ejecting device will be used.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes any type of suitable sheet-like material, such as paper, card stock, envelopes, labels, transparencies, Mylar, and the like. In one embodiment, print media 19 is a continuous form or continuous web print media 19. As such, print media 19 may include a continuous roll of unprinted paper.

Ink supply assembly 14, as one embodiment of a fluid supply assembly, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube.

In one embodiment, mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Controller 20 communicates with printhead assembly 12, mounting assembly 16, and media transport assembly 18. Controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, controller 20 provides control of printhead assembly 12 including timing control for ejection of ink drops from nozzles 13. As such, controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of controller 20 is located on printhead assembly 12. In another embodiment, logic and drive circuitry is located off printhead assembly 12.

Controller 20 may be implemented as a processor, logic elements, firmware, and software, or in any combination thereof.

Figure 2:
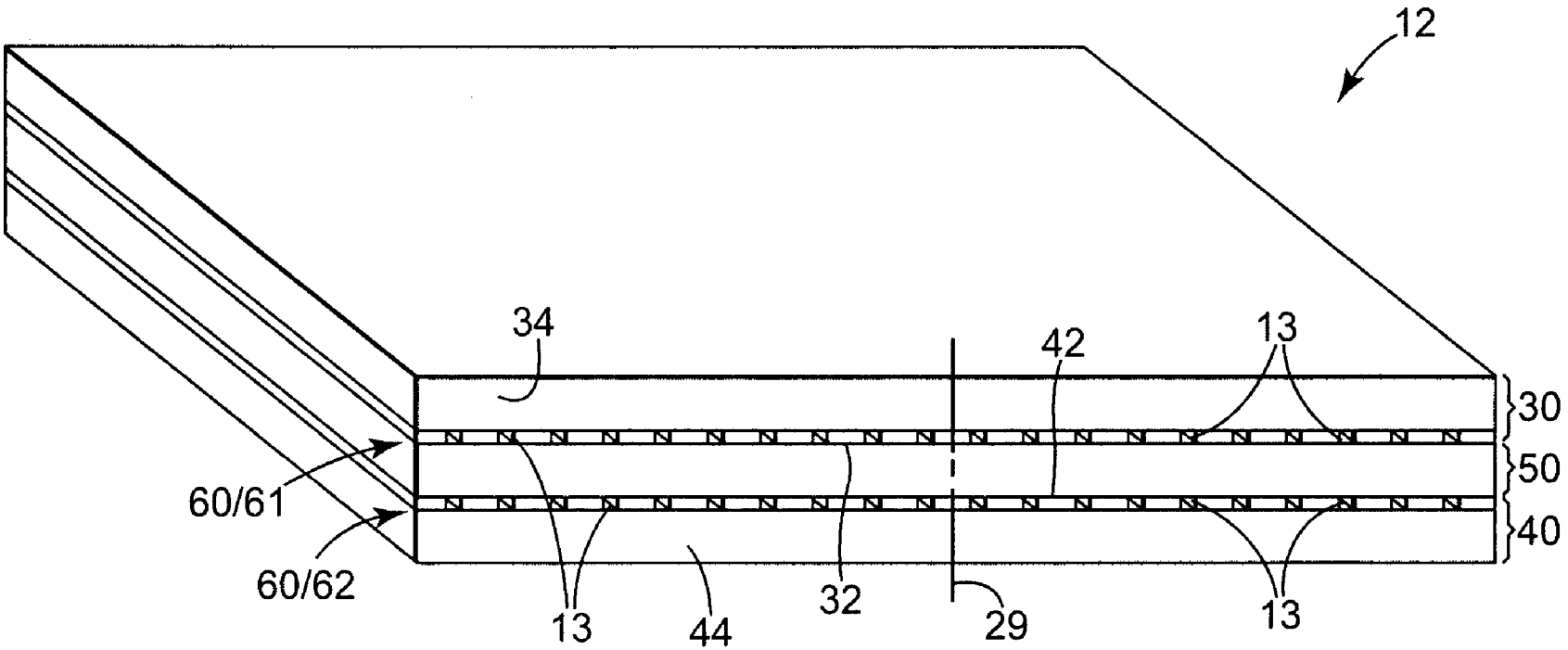
FIG. 2 is a schematic perspective view illustrating one embodiment of a printhead assembly according to the present invention.

FIG. 2 illustrates one embodiment of a portion of printhead assembly 12. In one embodiment, printhead assembly 12 is a multi-layered assembly and includes outer layers 30 and 40, and at least one inner layer 50. Outer layers 30 and 40 have a face or side 32 and 42, respectively, and an edge 34 and 44, respectively, contiguous with the respective side 32 and 42. Outer layers 30 and 40 are positioned on opposite sides of inner layer 50 such that sides 32 and 42 face inner layer 50 and are adjacent inner layer 50. As such, inner layer 50 and outer layers 30 and 40 are stacked along an axis 29.

As illustrated in the embodiment of FIG. 2, inner layer 50 and outer layers 30 and 40 are arranged to form one or more rows 60 of nozzles 13. Rows 60 of nozzles 13 extend, for example, in a direction substantially perpendicular to axis 29. As such, in one embodiment, axis 29 represents a print axis or axis of relative movement between printhead assembly 12 and print media 19. Thus, a length of rows 60 of nozzles 13 establishes a swath height of printhead assembly 12. In one embodiment, rows 60 of nozzles 13 span a distance less than approximately two inches. In another embodiment, rows 60 of nozzles 13 span a distance greater than approximately two inches.

In one embodiment, inner layer 50 and outer layers 30 and 40 form two rows 61 and 62 of nozzles 13. More specifically, inner layer 50 and outer layer 30 form row 61 of nozzles 13 along edge 34 of outer layer 30, and inner layer 50 and outer layer 40 form row 62 of nozzles 13 along edge 44 of outer layer 40. As such, in one embodiment, rows 61 and 62 of nozzles 13 are spaced from and oriented substantially parallel to each other.

In one embodiment, as illustrated in FIG. 2, nozzles 13 of rows 61 and 62 are substantially aligned. More specifically, each nozzle 13 of row 61 is substantially aligned with one nozzle 13 of row 62 along a print line oriented substantially parallel to axis 29. As such, the embodiment of FIG. 2 provides nozzle redundancy since fluid (or ink) can be ejected through multiple nozzles along a given print line. Thus, a defective or inoperative nozzle can be compensated for by another aligned nozzle. In addition, nozzle redundancy provides the ability to alternate nozzle activation amongst aligned nozzles.

Figure 3:
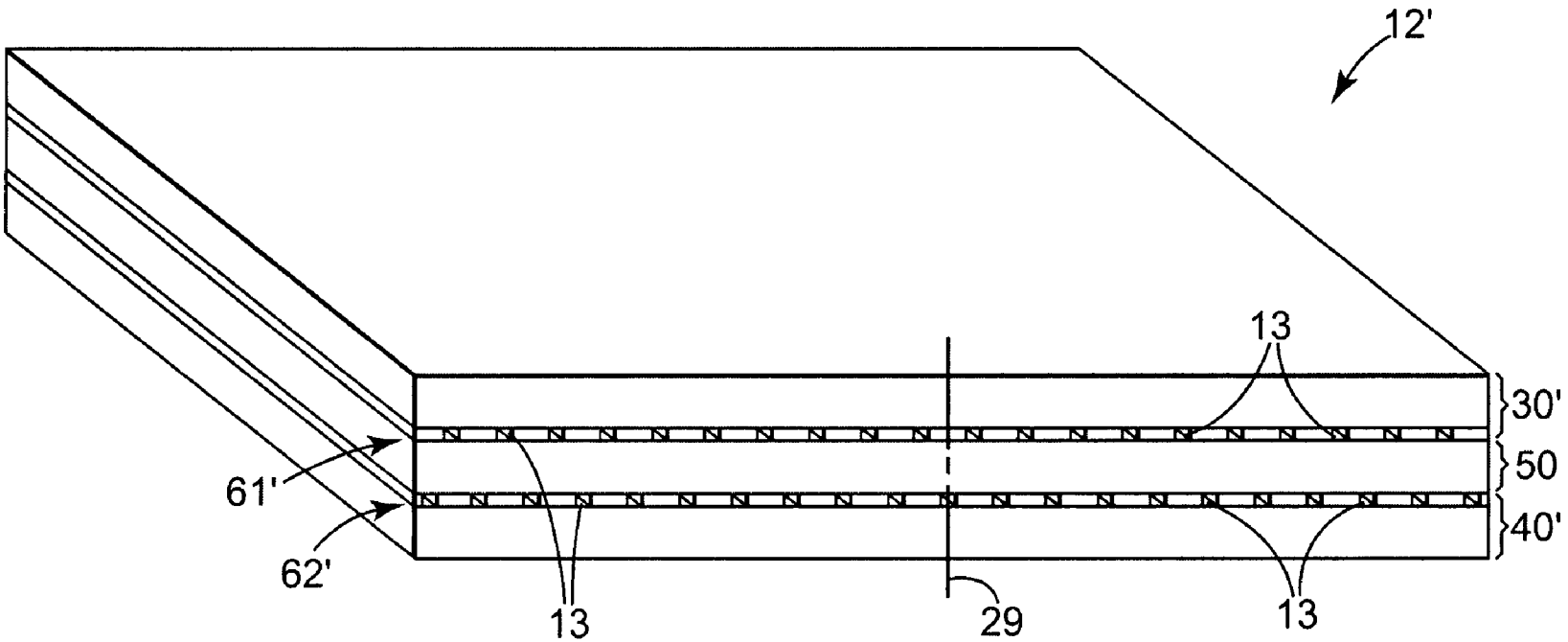
FIG. 3 is a schematic perspective view illustrating another embodiment of the printhead assembly of FIG. 2.

FIG. 3 illustrates another embodiment of a portion of printhead assembly 12. Similar to printhead assembly 12, printhead assembly 12' is a multi-layered assembly and includes outer layers 30' and 40', and inner layer 50. In addition, similar to outer layers 30 and 40, outer layers 30' and 40' are positioned on opposite sides of inner layer 50. As such, inner layer 50 and outer layers 30' and 40' form two rows 61' and 62' of nozzles 13.

As illustrated in the embodiment of FIG. 3, nozzles 13 of rows 61' and 62' are offset. More specifically, each nozzle 13 of row 61' is staggered or offset from one nozzle 13 of row 62' along a print line oriented substantially parallel to axis 29. As such, the embodiment of FIG. 3 provides increased resolution since the number of dots per inch (dpi) that can be printed along a line oriented substantially perpendicular to axis 29 is increased.

Figure 4:
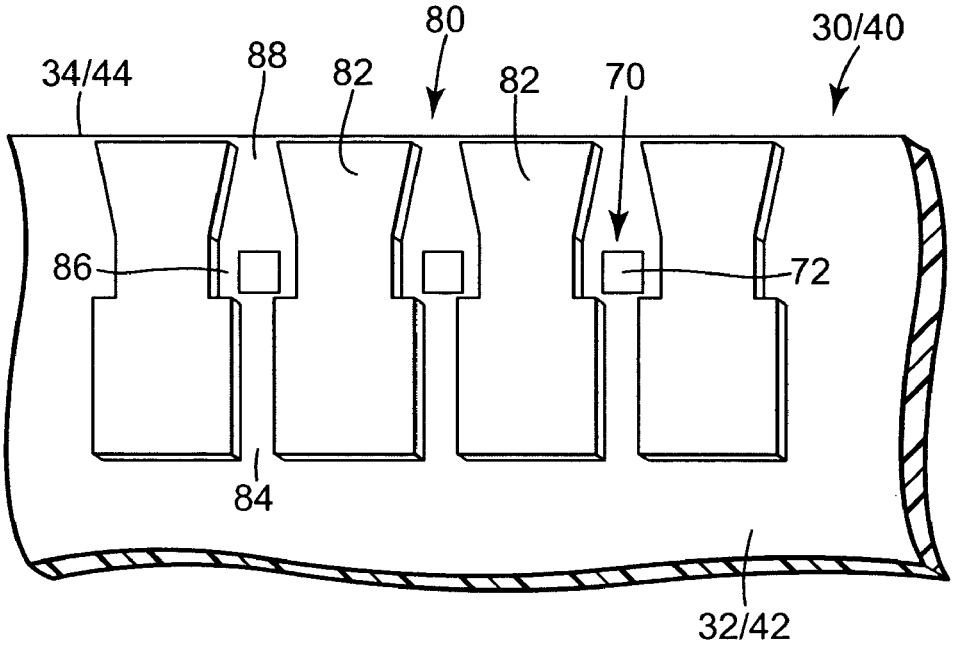
FIG. 4 is a schematic perspective view illustrating one embodiment of a portion of an outer layer of the printhead assembly of FIG. 2.

In one embodiment, as illustrated in FIG. 4, outer layers 30 and 40 (only one of which is illustrated in FIG. 4 and including outer layers 30' and 40') each include fluid ejecting elements 70 and fluid pathways 80 formed on sides 32 and 42, respectively. Fluid ejecting elements 70 and fluid pathways 80 are arranged such that fluid pathways 80 communicate with and supply fluid (or ink) to fluid ejecting elements 70. In one embodiment, fluid ejection elements 70 and fluid pathways 80 are arranged in substantially linear arrays on sides 32 and 42 of respective outer layers 30 and 40. As such, all fluid ejecting elements 70 and fluid pathways 80 of outer layer 30 are formed on a single or monolithic layer, and all fluid ejecting elements 70 and fluid pathways 80 of outer layer 40 are formed on a single or monolithic layer.

In one embodiment, as described below, inner layer 50 (FIG. 2) has a fluid manifold or fluid passage defined therein which distributes fluid supplied, for example, by ink supply assembly 14 to fluid pathways 80 and fluid ejecting elements 70 formed on outer layers 30 and 40.

In one embodiment, fluid pathways 80 are defined by barriers 82 formed on sides 32 and 42 of respective outer layers 30 and 40. As such, inner layer 50 (FIG. 2) and fluid pathways 80 of outer layer 30 form row 61 of nozzles 13 along edge 34, and inner layer 50 (FIG. 2) and fluid pathways 80 of outer layer 40 form row 62 of nozzles 13 along edge 44 when outer layers 30 and 40 are positioned on opposite sides of inner layer 50.

As illustrated in the embodiment of FIG. 4, each fluid pathway 80 includes a fluid inlet 84, a fluid chamber 86, and a fluid outlet 88 such that fluid chamber 86 communicates with fluid inlet 84 and fluid outlet 88. Fluid inlet 84 communicates with a supply of fluid (or ink), as described below, and supplies fluid (or ink) to fluid chamber 86. Fluid outlet 88 communicates with fluid chamber 86 and, in one embodiment, forms a portion of a respective nozzle 13 when outer layers 30 and 40 are positioned on opposite sides of inner layer 50.

In one embodiment, each fluid ejecting element 70 includes a firing resistor 72 formed within fluid chamber 86 of a respective fluid pathway 80. Firing resistor 72 includes, for example, a heater resistor which, when energized, heats fluid within fluid chamber 86 to produce a bubble within fluid chamber 86 and generate a droplet of fluid which is ejected through nozzle 13. As such, in one embodiment, a respective fluid chamber 86, firing resistor 72, and nozzle 13 form a drop generator of a respective fluid ejecting element 70.

In one embodiment, during operation, fluid flows from fluid inlet 84 to fluid chamber 86 where droplets of fluid are ejected from fluid chamber 86 through fluid outlet 88 and a respective nozzle 13 upon activation of a respective firing resistor 72. As such, droplets of fluid are ejected substantially parallel to sides 32 and 42 of respective outer layers 30 and 40 toward a medium. Accordingly, in one embodiment, printhead assembly 12 constitutes an edge or side-shooter design.

Figure 5:
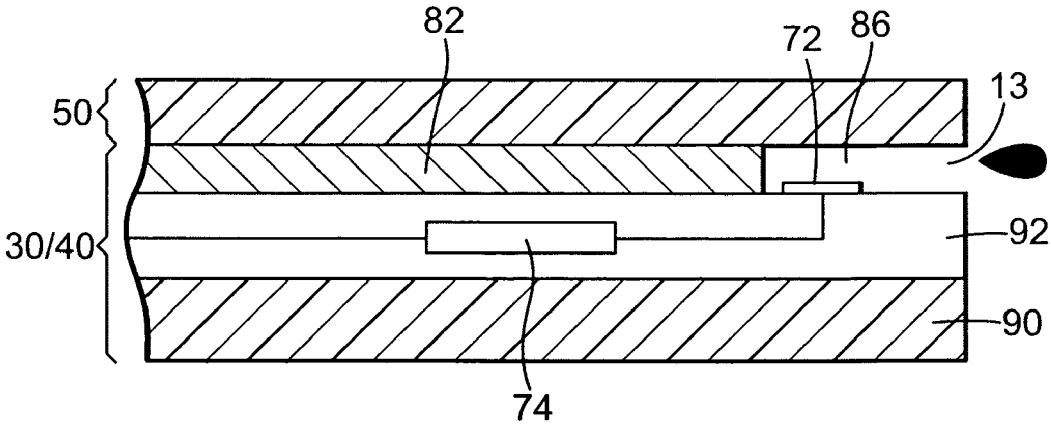
FIG. 5 is a schematic cross-sectional view illustrating one embodiment of a portion of the printhead assembly of FIG. 2.

In one embodiment, as illustrated in FIG. 5, outer layers 30 and 40 (only one of which is illustrated in FIG. 5 and including outer layers 30' and 40') each include a substrate 90 and a thin-film structure 92 formed on substrate 90. As such, firing resistors 72 of fluid ejecting elements 70 and barriers 82 of fluid pathways 80 are formed on thin-film structure 92. As described above, outer layers 30 and 40 are positioned on opposite sides of inner layer 50 to form fluid chamber 86 and nozzle 13 of a respective fluid ejecting element 70.

In one embodiment, inner layer 50 and substrate 90 of outer layers 30 and 40 each include a common material. As such, a coefficient of thermal expansion of inner layer 50 and outer layers 30 and 40 is substantially matched. Thus, thermal gradients between inner layer 50 and outer layers 30 and 40 are minimized. Example materials suitable for inner layer 50 and substrate 90 of outer layers 30 and 40 include glass, metal, a ceramic material, a carbon composite material, a metal matrix composite material, or any other chemically inert and thermally stable material.

In one embodiment, inner layer 50 and substrate 90 of outer layers 30 and 40 include glass such as Corning® 1737 glass or Corning® 1740 glass. In one embodiment, when inner layer 50 and substrate 90 of outer layers 30 and 40 include a metal or metal matrix composite material, an oxide layer is formed on the metal or metal matrix composite material of substrate 90.

In one embodiment, thin-film structure 92 includes drive circuitry 74 for fluid ejecting elements 70. Drive circuitry 74 provides, for example, power, ground, and control logic for fluid ejecting elements 70 including, more specifically, firing resistors 72.

In one embodiment, thin-film structure 92 includes one or more passivation or insulation layers formed, for example, of silicon dioxide, silicon carbide, silicon nitride, tantalum, poly-silicon glass, or other suitable material. In addition, thin-film structure 92 also includes one or more conductive layers formed, for example, by aluminum, gold, tantalum, tantalum-aluminum, or other metal or metal alloy. In one embodiment, thin-film structure 92 includes thin-film transistors which form a portion of drive circuitry 74 for fluid ejecting elements 70.

As illustrated in the embodiment of FIG. 5, barriers 82 of fluid pathways 80 are formed on thin-film structure 92. In one embodiment, barriers 82 are formed of a non-conductive material compatible with the fluid (or ink) to be routed through and ejected from printhead assembly 12. Example materials suitable for barriers 82 include a photo-imageable polymer and glass. The photo-imageable polymer may include a spun-on material, such as SU8, or a dry-film material, such as DuPont Vacrel®.

As illustrated in the embodiment of FIG. 5, outer layers 30 and 40 (including outer layers 30' and 40') are joined to inner layer 50 at barriers 82. In one embodiment, when barriers 82 are formed of a photo-imageable polymer or glass, outer layers 30 and 40 are bonded to inner layer 50 by temperature and pressure. Other suitable joining or bonding techniques, however, can also be used to join outer layers 30 and 40 to inner layer 50.

Methods for fabricating thin-film transistors arrays on monolithic structures are disclosed and discussed in more detail in U.S. Pat. No. 4,960,719 entitled "Method for Producing Amorphous Silicon Thin Film Transistor Array Substrate," and in U.S. Pat. No. 6,582,062 entitled "Large Thermal Ink Jet Nozzle Array Printhead," both of which are herein incorporated by reference in their entirety as if fully set forth herein.

Fire Enable Register

Figure 6:
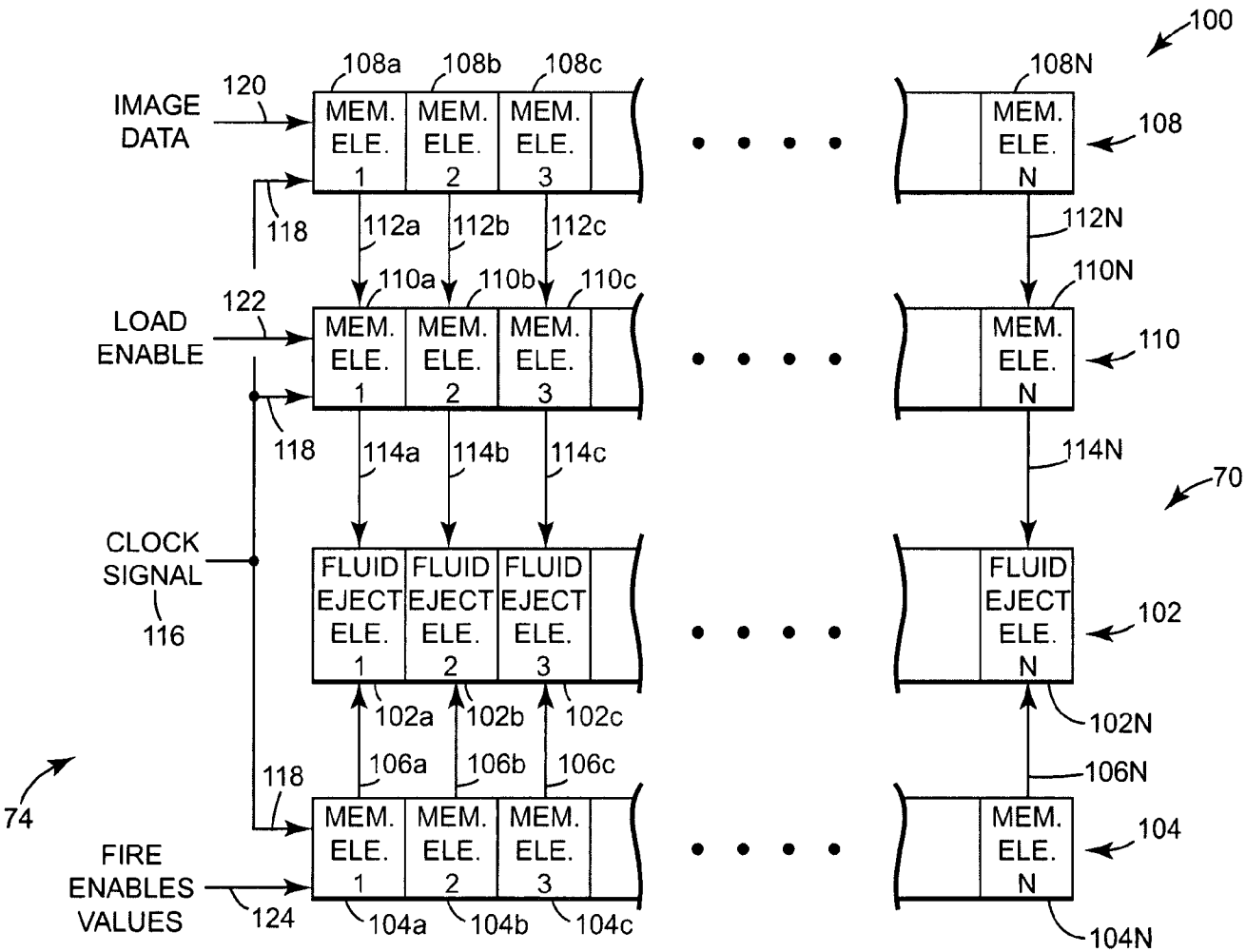
FIG. 6 is a block diagram illustrating a one embodiment of a printhead assembly according to the present invention.

FIG. 6 is a block diagram illustrating a portion of one embodiment of a printhead assembly 100 having drive circuitry 74 employing shift registering of fire enable values for controlling fluid ejecting elements 70. As illustrated in this embodiment, fluid ejecting elements 70 comprise a row 102 of N fluid ejecting elements, identified as fluid ejecting elements 102*a* to 102N. In one embodiment, row 102 comprises a row of drop-ejecting elements having a width substantially equal to a maximum dimension, e.g. width of a print medium that can be inserted into a printer in which the printhead is located. Drive circuitry 74 includes a fire enable shift register 104, a data input shift register 108, and a data hold shift register 110.

Fire enable shift register 104 includes N one-bit memory elements, indicated as memory elements 104*a* to 104N, each coupled to a corresponding one of the N fluid ejecting elements of row 102 via a path as indicated by paths 106*a* to 106N. Data input shift register 108 includes N one-bit memory elements, indicated as memory elements 108*a* to 108N. Data hold shift register 110 includes N one-bit memory elements, indicated as memory elements 110*a* to 110N. In one embodiment, a plurality of shift registers may be employed to form each of the shift registers. In other embodiments, alternative forms of data shifting may be employed, such as a random access memory (RAM) device employing a counter.

Each of the N one-bit memory elements of data hold shift register 110 is coupled to a corresponding one of the N one-bit memory elements of data input shift register 108 via a path as indicated by paths 112*a* to 112N. Each of the N one-bit memory elements of data hold shift register 110 is also coupled to a corresponding one of the N fluid ejecting elements of row 102 via a path as indicated by paths 114*a* to 114N. Additionally fire enable shift register 104, data input shift register 108, and data hold shift register 110 each receive a clock signal 116 having a clock cycle from controller 20 via a path 118.

In one embodiment, as described below, row 102 is configured to print a series of rows of image data representative of a displayable image by ejecting ink droplets via fluid ejecting elements 102*a* through 102N. For illustrative purposes, assume at the outset that each of the N one-bit memory elements of fire enable shift register 104, data input shift register 108, and data hold shift register 110 contains a disable value, e.g. "0."

To begin a print job, a first row of image data comprising N bits of image data is serially shifted into data input shift register 108 from controller 20 via a path 120, with one bit of image data being shifted into data input shift register during each clock cycle of clock signal 116. Each of the N bits of image data has a value of "1" or "0", with "1" being an enabling value and "0" being a disabling value.

After N clock cycles, data input shift register 108 is filled with the N bits of image data of the first row of image data, with each of the N memory elements storing a different one of the N image data bits. Data hold shift register 110 then receives a load enable signal from controller 20 via a path 122, and the N image data bits of the first row of image data are parallel-shifted from data input shift register 108 to data hold shift register 110 via paths 112*a* through 112N. In other embodiments, data hold shift register 110 may receive a row of image data via a series of partial image data shifts occurring over a number of clock cycles.

To print the first row of data stored in data hold shift register 110, a series of one-bit fire enable values representative of a fire enable pulse is shifted into fire enable shift register 104 from controller 20 via a path 124. One bit of the series is shifted with each clock cycle, with the entire series being received in a print cycle, wherein one row of image data is printed in a print cycle. In one embodiment, each fire enable value has a value of "1" or "0", with "1" being an enabling value and "0" being a disabling value. A first X fire enable values of the series, where X is at least equal to one, received during a first X clock cycles of the print cycle have a value of "1", and a final N fire enable values of the series received during a final N clock cycles of the print cycle have a value of "0." The final N fire enable values of the series cause the first X fire enable values having the enabling value to be shifted through fire enable shift register 104, thereby generating a fire enable pulse having a duration, which can be referred to as pulse width, which is equal to a product of X multiplied by a duration of the clock cycle. This fire enable pulse instructs the appropriate fluid ejecting element to eject fluid. At the end of a given print cycle, each of the N memory elements 104*a* through 104*n* of fire enable shift register 104 is storing a fire enable value having a value of "0."

Upon each clock cycle of clock signal 116, each of the N fluid ejecting elements 102*a* through 102N of row 102 receives the fire enable value from the corresponding memory element of fire enable shift register via paths 106*a* through 106*n* and the image data bit from the corresponding memory element of data hold shift register 110 via paths 114*a* through 114N. As the X fire enable values having a value of "1" propagate through fire enable shift register 104 and reach a given fluid ejecting element, the given fluid ejecting element is enabled to generate an ink drop. If the image data bit from the memory element of data hold shift register 110 corresponding to the given fluid ejecting element has a value of "1", the fluid ejecting element generates an ink droplet. If the image data bit has a value of "0", though enabled, the given fluid ejecting element will not generate an ink droplet. When a first of the final N fire enable values having a value of "0" reaches the given fluid ejecting element, the fluid ejecting element is disabled from generating an ink droplet, regardless of the value of the image data bit received from the corresponding memory element of data hold register 110.

Simultaneously with fire enable shift register 104 receiving the X plus N fire enable values during the print cycle of the first row of image data, a next row of image data to be printed is serially-shifted into data input shift register 108 from controller 20 via path 120. When the print cycle of the first row of data has been completed, the N image data bits of the next row of image data are parallel-shifted from data input shift register 108 to data hold register 110 and a print cycle for the next row of image data begins. This process is repeated for each row of image data of the displayable image until the print job has been completed.

Figure 7:
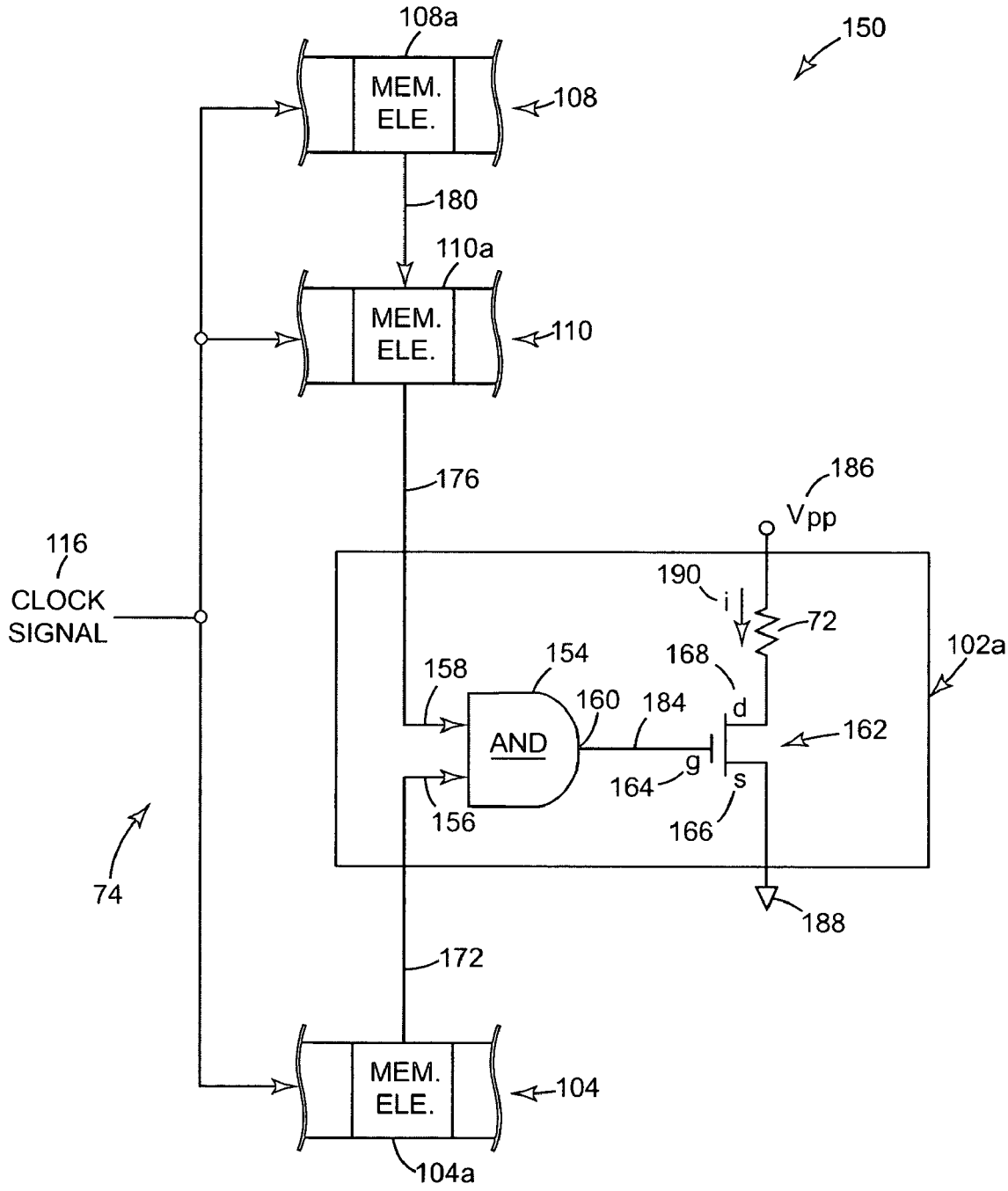
FIG. 7 is a schematic block diagram illustrating one embodiment of a fluid ejecting element according to the present invention.

FIG. 7 is a schematic block diagram illustrating one embodiment of drive circuitry 74 of each fluid ejecting element 70, such as fluid ejecting element 102*a*. Fluid ejecting element 102*a* includes an AND-gate 154 and a switch, which in one embodiment is a field effect transistor (FET) 162. AND-gate 154 includes a first input 156, a second input 158, and an output 160. FET 162 includes a gate 164, a source 166, and a drain 168.

First input 156 is coupled via a path 172 to corresponding memory element 104*a* of a fire enable shift register 104, wherein memory element 104*a* stores the fire enable value. Second input 158 is coupled via a path 176 to corresponding memory element 110*a* of data hold shift register 110. Memory element 110*a* is, in-turn, coupled via a path 180 to corresponding memory element 108*a* of data input shift register 108.

Gate 164 of FET 162 is coupled via a path 184 to output 160 of AND-gate 154. Firing resistor 72 has a first terminal coupled to a voltage source 186 and a second terminal coupled to drain 168. Source 166 is coupled to ground 188. AND-gate 154 is configured to provide a fire signal via path 184 to gate 164 based on the fire enable value and image data value stored in corresponding memory elements 104*a* and 110*a*, respectively. Upon each cycle of a clock signal, such as a clock signal 116, AND-gate 154 is configured to receive the fire enable value presently stored in memory element 104*a* and the image data value presently stored in memory element 110*a* at first input 156 and second input 158, respectively.

When both the fire enable value and the image data value have a value of "1", AND-gate 154 provides a fire signal to gate 164, causing FET 162 to "turn on" and couple the second terminal of firing resistor 72 to ground 188, which correspondingly causes a current 190 to pass from voltage source 186 to ground 188 through firing resistor 72. Current 190 through firing resistor 72 heats ink in a corresponding ink chamber, such as ink chamber 86, causing an ink droplet to be ejected through a corresponding nozzle, such as nozzle 13. When either the fire enable value and/or the image data value have a value of "0", AND-gate 154 does not provide a fire signal to turn on FET 152, current 190 does not flow through firing resistor 72, and no ink droplet is ejected by fluid ejecting element 152.

Figure 8A:
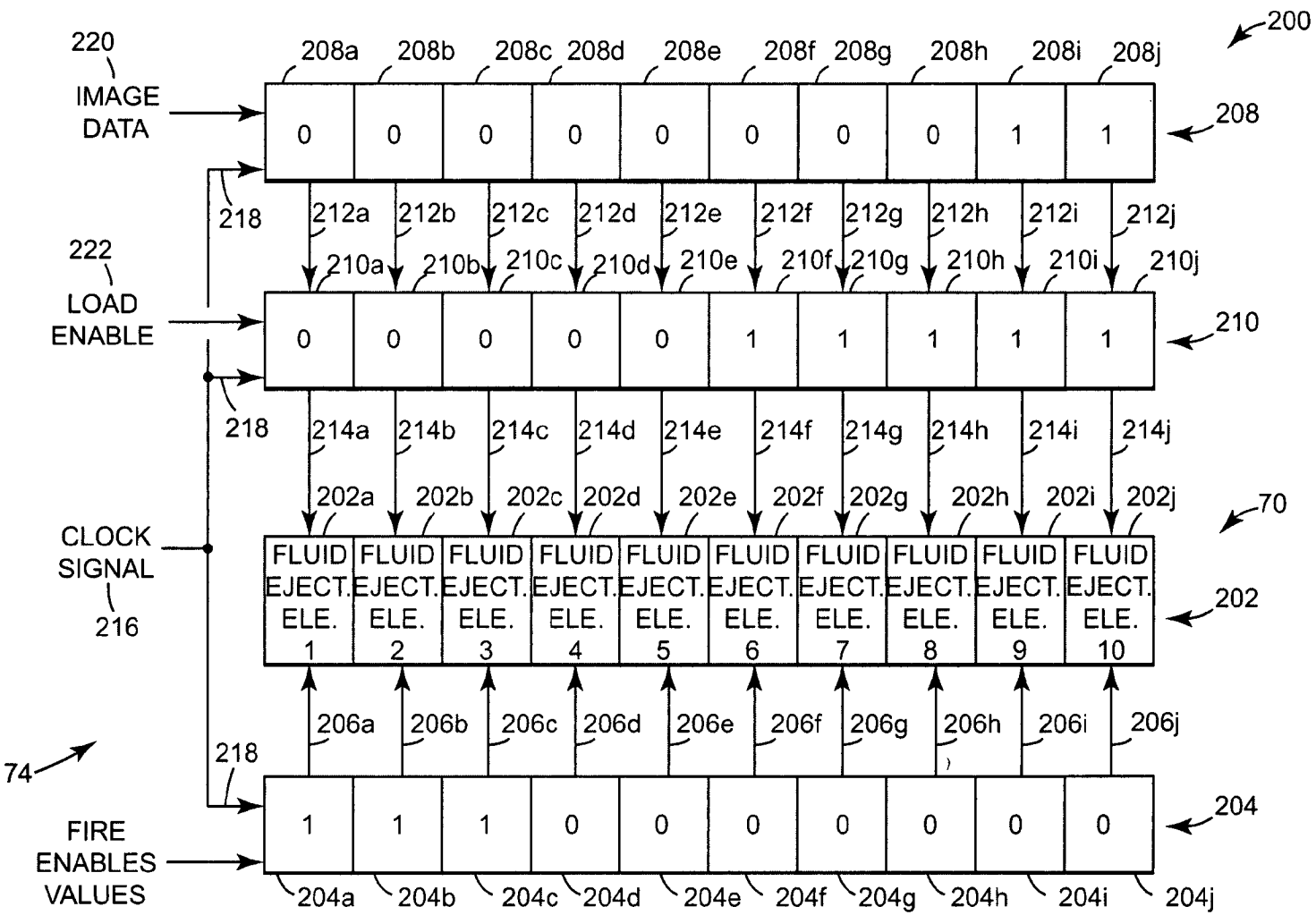
FIG. 8A is a block diagram illustrating an example operation of one embodiment of a printhead assembly according to the present invention.
Figure 8B:
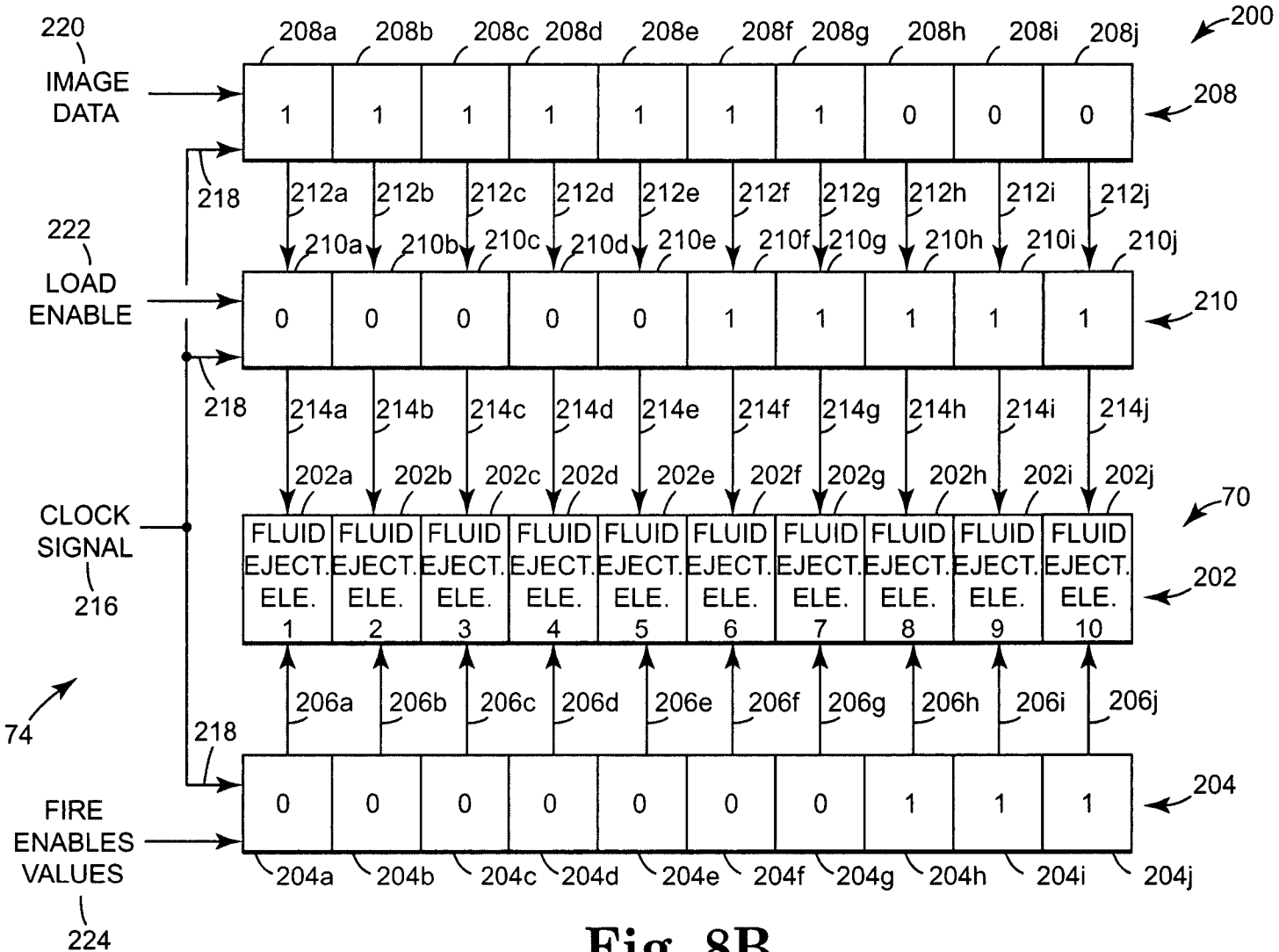
FIG. 8B is a block diagram illustrating an example operation of one embodiment of a printhead assembly according to the present invention.
Figure 8C:
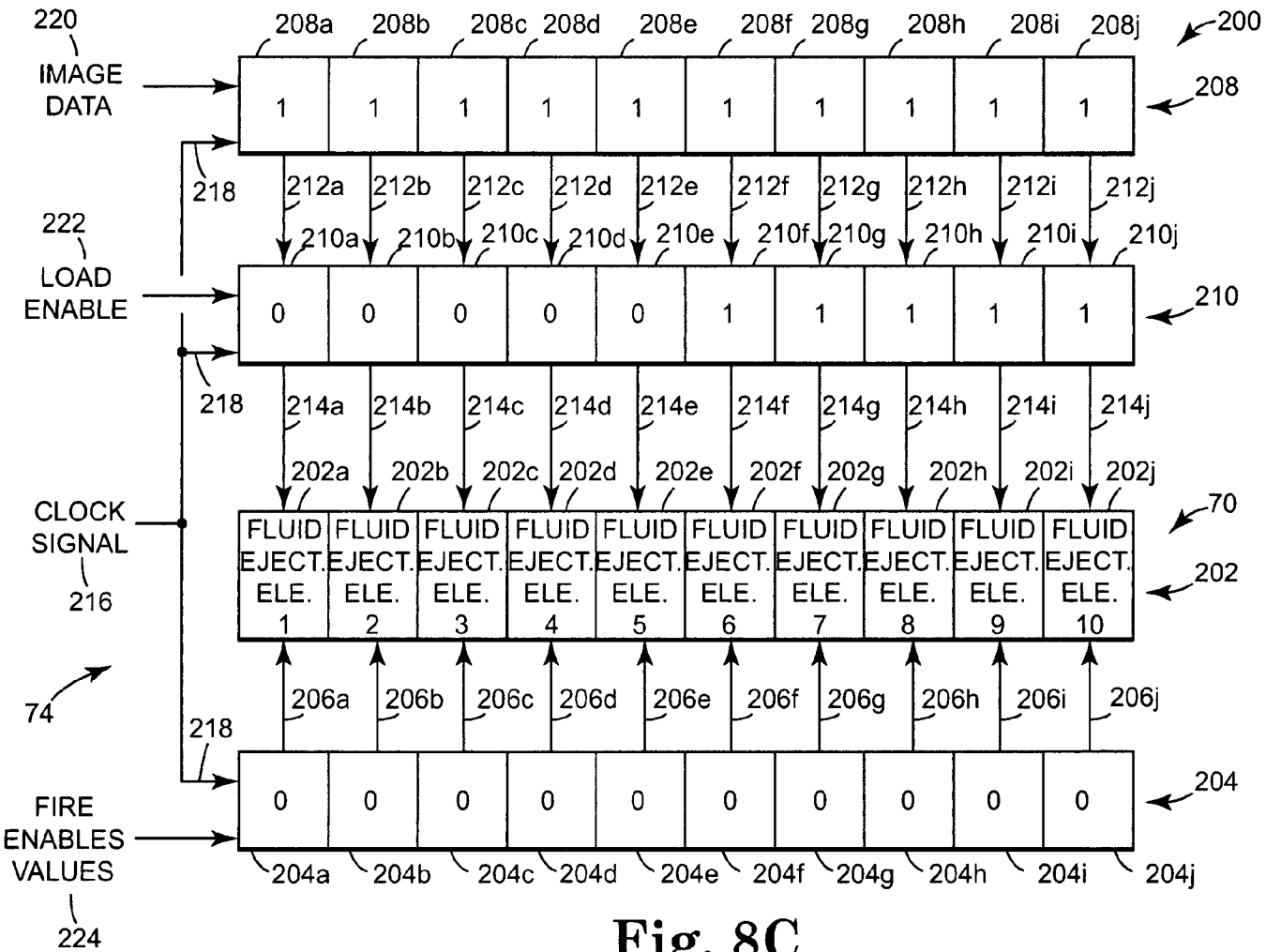
FIG. 8C is a block diagram illustrating an example operation of one embodiment of a printhead assembly according to the present invention.

FIGS. 8A, 8B and 8C are schematic block diagrams illustrating an example operation of one embodiment of a printhead assembly 200 according to the present invention having drive circuitry 74 employing shift registering of fire enable of fire enable values for controlling fluid ejecting elements 70. In the example operation illustrated by FIGS. 8A to 8C, fluid ejecting elements 70 comprise a row 202 of ten (i.e., N=10) fluid ejecting elements identified as fluid ejecting elements 202*a* to 202*j*. Drive circuitry 74 further includes a fire enable shift register 204 having memory elements 204*a* to 204*j*, a data input shift register 208 having memory elements 208*a* to 208*j*, and a data hold shift register 210 having memory elements 210*a* to 210*j*. Fire enable shift register 204, data input shift register 208, and data hold shift register 210 receive a clock signal 216 via path 218.

In the example operation of FIGS. 8A to 8C, row 202 of fluid ejecting elements 202*a* to 202*j* is illustrated as printing a row of image data during a print cycle in response to a serial fire enable pulse comprising a series of thirteen fire enable values, with a first three fire enable values of the pulse (i.e, X=3) having a value of 1, and a final ten enable values of the pulse (i.e., N=10) having a value of "0". The print cycle for a row of data thus comprises thirteen cycles of clock signal 216. Additionally, for illustrative purpose, each of the memory elements 204*a* to 204*j* of fire enable shift register 204 is shown as initially storing a fire enable value of "0," i.e. disable, and the row of image data comprising a series of ten image data bits is shown as already having been shifted into data hold shift register 210 from data input shift register via paths 212*a* to 212*j*.

FIG. 8A illustrates a status of each of the memory elements of fire enable shift register 204, data input shift register 208, and data hold shift register 210 after three clock cycles of the print cycle for the row of image data. Fire enable shift register 204 is indicated as having received the first three fire enable values from controller 20 via a path 224, each having a value of "1" and being held in memory elements 204*a* to 204*c*. As a result, fluid ejecting elements 202*a* to 202*c* are enabled to eject ink.

Data hold shift register 210 continues to hold the row of image data, with memory elements 210*a* to 210*e* storing a value of "0" and memory elements 210*f* to 210*j* storing a value of "1". In other words, the row of image data is "0000011111" and was loaded from data input shift register 208 prior to the three clock cycles of the print cycle. Thus, even though enabled to eject ink, fluid ejecting elements 202*a* to 202*c* will not eject ink because the image data bits stored in and previously received from corresponding memory elements 210*a* to 210*c* via paths 214*a* to 214*c* each have a disable value.

FIG. 8B illustrates a status of each of the memory elements of fire enable shift register 204, data input shift register 208, and data hold shift register 210 after ten clock cycles of the print cycle for the row of image data. Data hold shift register 210 is indicated as continuing to hold the first row of image data in memory elements 210*a* to 210*j*. However, data input shift register 208 is now indicated as holding in memory elements 208*a* to 208*j* the first ten image data bits of the next row of image data to be printed, with seven of the ten image data bits indicated as having a value of "1" and three having a value of "0."

Fire enable shift register 204 is now indicated as having received seven of the ten final enable values of the fire enable pulse, each having a disable value, "0", and being stored in memory elements 204*a* to 204*g*. Consequently, the first three fire enable values having a value of "1" have been shifted to memory elements 204*h* to 204*j*. As a result, fluid ejecting elements 202*h* to 202*j* are enabled to eject ink. Furthermore, because the image data bits stored in and received from corresponding memory elements 210*h* to 210*j* via paths 214*h* to 214*j* each have a value of "1", fluid ejecting elements 202*h* to 202*j* are, in fact, in the process of generating ink droplets since both memory elements 210*h* to 210*j* and memory elements 204*h* to 204*j* contain values having enabling values.

FIG. 8C illustrates a status of each of the memory elements of fire enable shift register 204, data input shift register 208, and data hold shift register 210 after the thirteen clock cycles of the print cycle, i.e. the entire print cycle in this example, for the row of image data have been completed. The first three fire enable values having a value of "1" have been shifted through fire enable shift register 204, and fire enable shift register 204 now contains in memory elements 204*a* to 204*j* the final ten fire enable values of the print cycle for the row, each having a value of "0". As a result, none of the ten fluid ejecting elements 202*a* through 202*j* are enabled to generate an ink droplet.

Data hold shift register 210 is indicated as continuing to hold the first row of image data in memory elements 210*a* through 210*j*. However data input shift register 208 is now indicated as containing the next row of image data, with memory elements 208*a* to 208*j* seven of which storing image data values of "1". In other words, the next row of image data is "1111111000". The next row of image data will be shifted from data input shift register 208 to data hold shift register 210 upon receipt of a load enable signal from controller 20 via path 222, and the above process will be repeated until each subsequent image data row of a print job has been printed by printhead 200.

As illustrated by FIGS. 8A, 8B, and 8C above, as the first three fire enable values having a value of "1" are shifted through fire enable shift register 204 during the print cycle for the first row of image data, each of the fluid ejecting elements 202*a* to 202*j* is enabled to generate an ink droplet for three cycles of clock signal 216. As a result, those fluid ejecting elements having a corresponding image data bit having a value of "1", in the above illustration ink ejecting elements 202*f* to 202*j*, will be energized for three clock cycles to eject ink. Thus, the number of fire enable values having a value of "1" multiplied by a duration of a cycle of clock signal 116 determines for any single fluid ejection element a fire enable duration, or fire enable pulse width, during which time each of the fluid ejecting elements 202*a* to 202*j* will be enabled to eject ink. Consequently, the fire enable pulse width can be varied by adjusting a frequency of clock signal 216 or by modifying the number of fire enable values having a value of "1" in the series of fire enable values representative of a fire enable pulse.

It should be noted that while FIGS. 8A–8C depict a row with 10 fluid ejection elements, the actual number of ink ejection elements may vary depending on the desired application and printer.

Fire Enable Control

One characteristic of an array is that different sections, or zones, of an array are typically at different temperatures. As a result, in a zone that is at an already elevated temperature, the ink does not require as much energy to be heated to a temperature to produce nucleation as ink in a cooler zone. If the same amount of energy is applied to each firing resistor of the array, those firing resistors in a zone at an already elevated temperature may become over-energized while those in a cooler zone may receive too little energy. Too little energy may cause print quality degradation, while too much energy may shorten an expected operating life of a firing resistor. As a result, energy control is a beneficial feature in printhead assemblies of inkjet printing systems, and is particularly beneficial in printhead assemblies of wide array inkjet printing systems, where larger areas increase the potential for thermal gradients.

Figure 9:
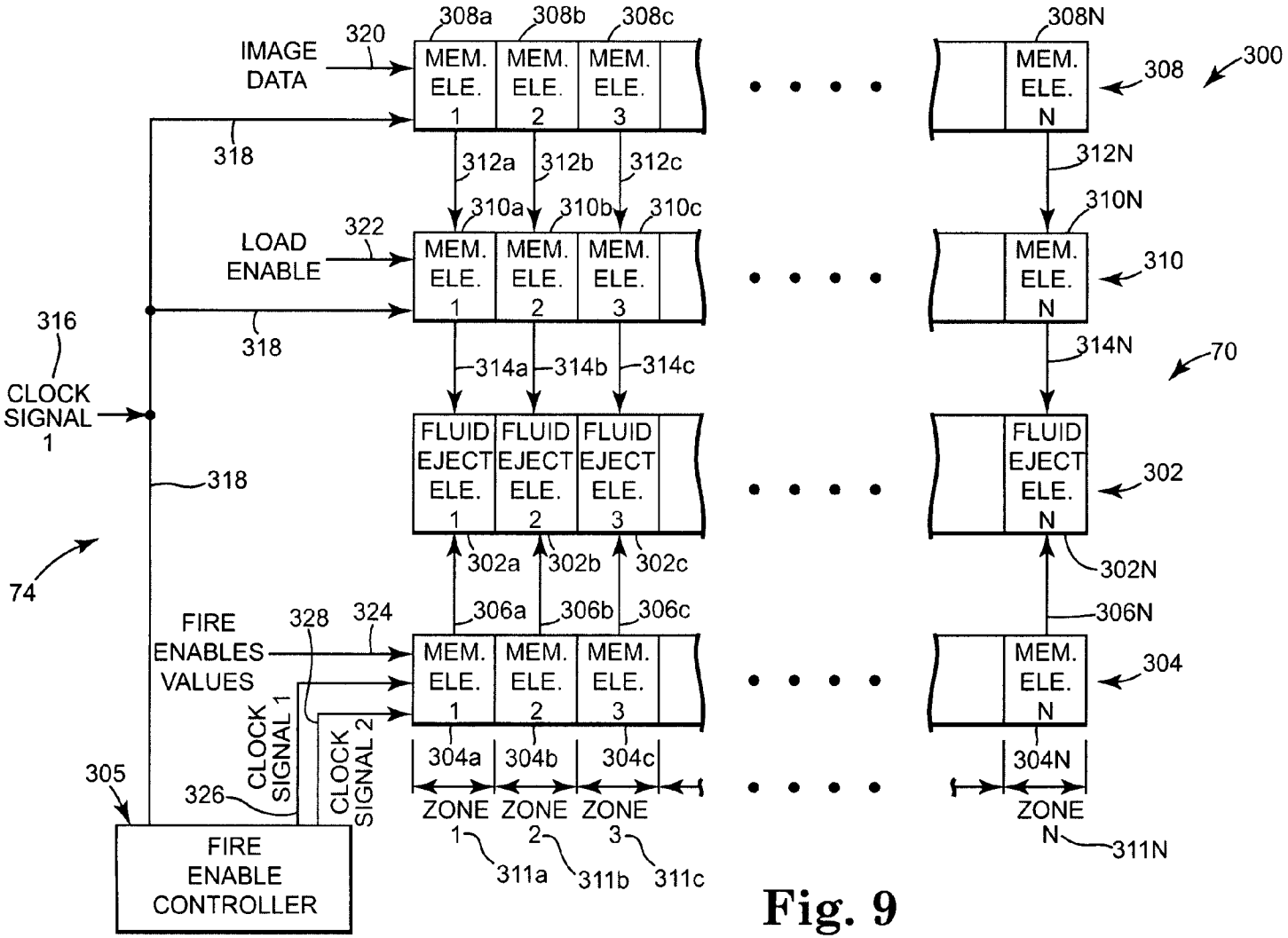
FIG. 9 is a block diagram illustrating generally portions of one embodiment of a printhead assembly employing registering of fire enable values for controlling energy provided to fluid ejecting elements.

FIG. 9 is a block diagram illustrating generally portions of one embodiment of a printhead assembly 300 according to the present invention having drive circuitry 74 employing fire enable values for controlling energy provided to fluid ejecting elements 70. In the illustrated embodiment, fluid ejecting elements 70 comprise a row 302 of N fluid ejecting elements, identified as fluid ejecting elements 302*a* to 302N. In one embodiment, row 302 comprises a row of fluid ejecting elements having a width substantially equal to a maximum dimension, e.g. width, of a print medium that can be inserted into a printer in which the printhead is located. Printhead assembly 300 further includes a row 304 of N fire enable memory elements, illustrated as 304*a* to 304N, a fire enable controller 305, a data input shift register 308, and a data hold shift register 310.

In the illustrated embodiment, each of the N fire enable memory elements 304*a* to 304N is coupled to a corresponding one of the N fluid ejecting elements of row 302 via paths 306*a* to 306N. Data input shift register 308 includes N one-bit memory elements, illustrated as 308*a* to 308N, and data hold shift register 310 includes N one-bit memory elements, illustrated as 310*a* to 310N. Additionally, fire enable memory elements 304*a* to 304N of row 304 are arranged into N memory element zones, identified as memory element zones 311*a* to 311N. In the illustrated embodiment, each fire enable memory element 304*a* to 304N corresponds to a different one of the zones 311*a* to 311N.

Each of the N one-bit memory elements of data input shift register 308 is coupled to a corresponding one of the N one-bit memory elements of data hold shift register 310 via paths 312*a* to 312N. Each of the N one-bit memory elements of data hold shift register 310 is, in-turn, coupled to a corresponding one of the N fluid ejecting elements of row 302 via paths 314*a* to 314N. Additionally, data input shift register 308, data hold shift register 310, and fire enable controller 305 each receive a first clock signal 316 having a clock rate via a path 318 from a controller, such as controller 20 (see FIG. 1).

In one embodiment printhead assembly 300 is configured to print a row of image data comprising N bits of image data in a fashion similar to that described above for printhead assembly 200. As such, the N bits of image data are initially serially-shifted into data input shift register 308 via a path 320 from a controller, such as controller 20 (see FIG. 1), with one bit of image data being shifted upon each clock cycle of clock signal 316. Each of the N bits of image data has value of a "1" or "0", with a "1" indicating that there is image data to be printed and a "0" indicating that there is no image data to be printed. After N cycles of first clock signal 316, data input shift register 308 is filled with the N bits of image data of the row, at which point data hold shift register 310 receives a load enable signal from controller 20 via a path 322 and the N bits of image data are parallel-shifted from data input shift register 308 to data hold shift register 310 via paths 312*a* to 312N.

Row 304 of fire enable memory elements then receives fire enable values from controller 20 via path 324, with each fire enable memory element 304*a* to 304N having at least one enabling value and at least one disabling value. Upon each cycle of first clock signal 316, each of the fluid ejecting elements 302*a* to 302N receives the fire enable value from the corresponding fire enable memory element of row 304 and image data from the corresponding memory element of data hold shift register 310 via paths 306 and 314, respectively. Each fluid ejecting element 302*a* to 302N is configured to eject ink when the corresponding fire enable value is an enabling value and when there is image data to be printed. In other words, when the corresponding memory element of data hold shift register 310 is enabled (i.e., holds image data to be printed), each fluid ejecting element 302 will be energized for ink ejection so long as the corresponding fire enable memory element of row 304 has an enabling value.

Fire enable controller 305 provides to fire enable memory elements 304*a* to 304N the first clock signal 316 via a path 326 and a second clock signal having a clock rate via a path 328. By varying the rate of the second clock relative to the rate of the first clock, fire enable controller 305 is configured to individually control for each zone of memory elements 311*a* to 311N a duration for which the at least one enabling value and the at least one disabling value are stored. By controlling this duration for each zone 311 of fire enable memory elements, fire enable controller 305 controls the energy provided to fluid ejecting elements 302 corresponding to each zone. In the illustrated embodiment, because each zone 311 corresponds to a single fluid ejecting memory element 304, fire enable controller 305 individually controls the energy provided to each fluid ejecting element 302*a* to 302N.

In one embodiment, fire enable controller 305 varies the rate of the second clock based on temperature data of each zone 311. In other embodiments, fire enable controller 305 varies the rate of the second clock based on a power supply voltage level, average firing resistor values associated with each zone 311, and prior knowledge of appropriate energy levels under similar conditions. Alternatively, a single clock that varies in frequency based upon the position of the "pulse" relative to row 302 of fluid ejecting elements may be utilized in lieu of first and second clocks 326 and 328.

Figure 10:
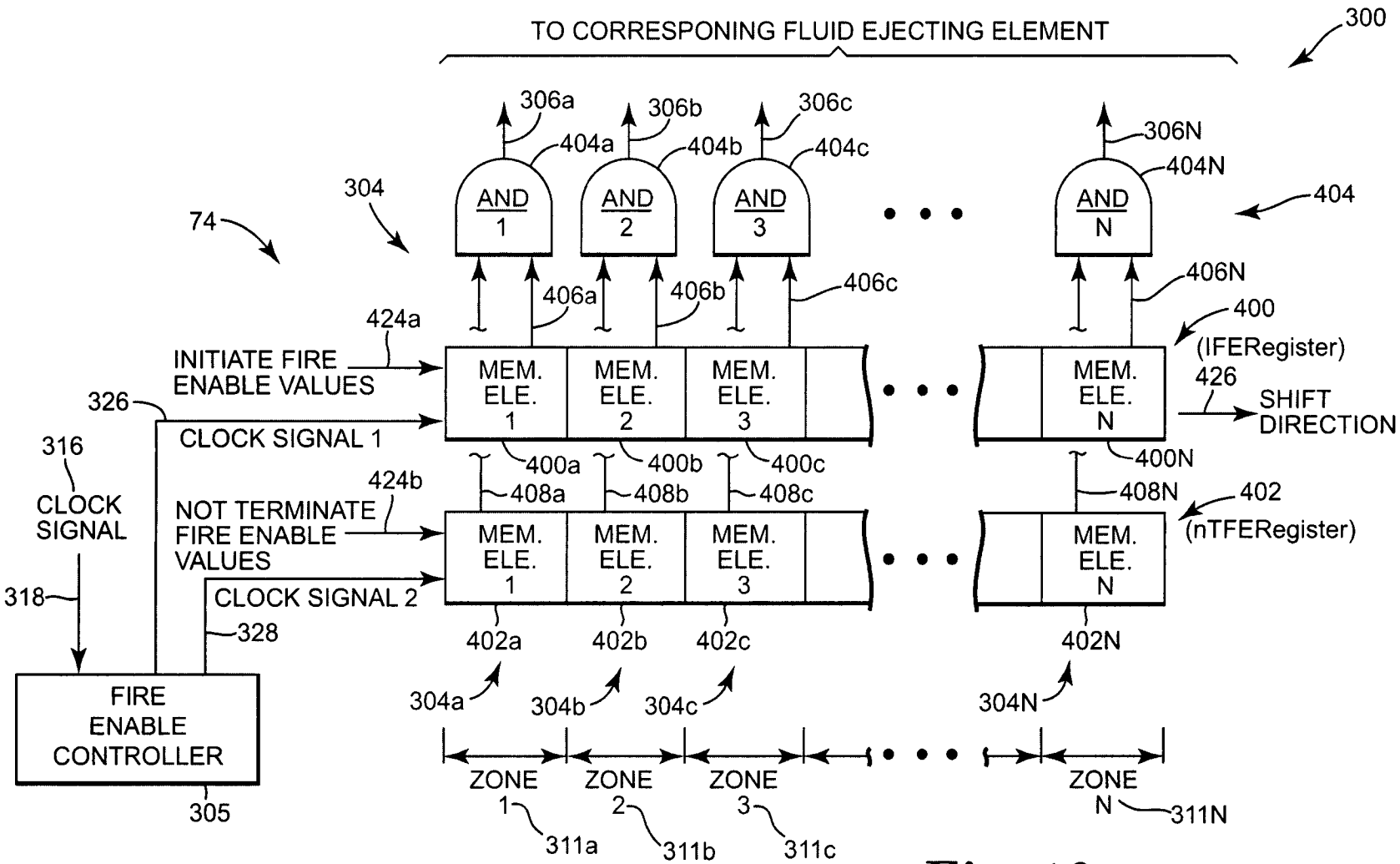
FIG. 10 is a schematic block diagram illustrating portions of one embodiment of a printhead assembly for controlling energy provided to fluid ejecting elements.

FIG. 10 is a schematic block diagram illustrating portions of one embodiment of printhead assembly 300 for controlling energy provided to fluid ejecting elements 70. Printhead assembly 300 includes fire enable controller 305, an initiate fire enable (IFE) shift register 400, and a not-terminate fire enable (nTFE) shift register 402. IFE shift register 400 includes N one-bit memory elements 400*a* to 400N, and nTFE shift register 402 includes N one-bit memory elements 402*a* to 402N.

Printhead assembly 300 further includes a row 404 of N AND-gates, illustrated as 404*a* to 404N, with each AND-gate having a first and a second input and an output. Each of the N one-bit memory elements of IFE shift register 400 is coupled to a first input and each of the N one-bit memory elements of nTFE shift register 402 is coupled to a second input of a corresponding one of the row 404 of AND-gates via paths 406 and 408, respectively. The output of each of the AND-gates 404*a* to 404N is coupled to a corresponding one of the N fluid ejecting elements 302*a* to 302N (see FIG. 9) via paths 306*a* to 306N. Together, each AND-gate of row 404 and the corresponding one-bit memory elements of the IFE shift register 400 and nTFE shift register 402 form one memory element of the row 304 of N memory elements 304*a* to 304N. For example, AND-gate 404*a* and one-bit memory elements 400*a* and 402*a* together form memory element 304*a*.

Fire enable controller receives first clock signal 316 via path 318. Fire enable controller provides the first clock signal 316 to IFE shift register 400 via path 326 and the second clock signal to nTFE shift register 402 via path 328. IFE register 400 receives initiate fire enable (IFE) values via a path 424*a* and nTFE register 402 receives not terminate fire enable (nTFE) values via a path 424*b*. In one embodiment, the IFE values and nTFE values are received from a controller, such as controller 20.

To print a row of data stored in data hold shift register 310, a series of one-bit IFE values is serially shifted into IFE shift register 400 via path 424*a*, with one bit of the series being shifted each cycle of the first clock signal. Each IFE value has a value of "1" or "0", with "1" being an enabling value and "0" being a disabling value. Initially, each memory element 400*a* to 400N of IFE shift register 400 contains a "0" while each memory element 402*a* to 402N of nTFE shift register 402 contains a "1".

To begin, each of the IFE values of the series has a value of "1". As the IFE values having a value of "1" are shifted in direction 426 across IFE shift register 400, the AND-gates 404 where the corresponding IFE shift register 400 and nTFE shift register 402 memory elements are each holding a value of "1" provides a fire enable signal being an enabling value to its corresponding fluid ejecting element 302 via path 306. At this point, the corresponding fluid ejecting elements 302 that also have image data having a value of "1" stored in the corresponding memory element of data hold shift register 310 begin conducting an electrical current through firing resistor 72 to eject ink (see FIG. 7).

After a desired number of IFE values having a value of "1" have been shifted into IFE shift register 400, one-bit IFE values having a value of "0" are shifted into IFE shift register 400. One bit is shifted with each cycle of clock signal 1 at 326 until each of the memory elements 400*a* to 400N once again holds a "0". At some point after the IFE shift register begins receiving IFE values having a value of "1" but before the IFE shift register begins receiving IFE values having a value of "0", nTFE shift register 402 begins receiving nTFE values having a value of "0", if an adjustment is to be made to the pulse width. The nTFE shift register 402 continues to receive nTFE values having a value of "0" until IFE shift register 400 begins to receive IFE values having a value of "0". At this point, nTFE values having a value of "1" are shifted into nTFE shift register 402 until each of the memory elements 402*a* to 402N once again holds a "1".

As the nTFE values having a value of "0" reach the memory elements of nTFE register 402 where the corresponding memory elements of the IFE shift register 400 hold a value of "1", the corresponding AND-gates 400 no longer provide a fire enable signal being an enabling value, but instead provide a fire enable signal being a disabling value. As a result, the corresponding fluid ejecting elements 302 cease conducting an electrical current through firing resistor 72.

At a given fluid ejecting element 302, a duration between receiving from the associated AND-gate 404 the fire enable signal being the enabling value and receiving the fire enable signal having the disabling value defines a width of a fire enable pulse for the given fluid ejecting element. In other words, the fire enable pulse width for a given fluid ejecting element 302 is the duration between the corresponding memory element of IFE shift register 400 receiving an IFE value having a value of "1" and the corresponding memory element of nTFE shift register 402 receiving an nTFE value having a value of "0". A maximum width of the fire enable pulse is determined by the number of IFE values having a value of "1" shifted into IFE shift register 400.

If the rate of the second clock is equal to the rate of the first clock 316, each fluid ejecting element 302*a* to 302N receives a fire enable signal having a substantially equal pulse width from corresponding AND-gates 404*a* to 404N. To vary the width of the fire enable pulse across row 302 of fluid ejecting elements 302*a* to 302N, fire enable controller varies the rate of the second clock relative to the first clock 316. When fire enable controller 305 provides a second clock having a rate less than the rate of the first clock 316, the width of the fire enable pulse increases at each adjacent memory element of row 304, up to the maximum width, with fluid ejecting element 302*a* receiving a fire enable pulse having the shortest duration and fluid ejecting element 302N receiving the fire enable pulse having the longest duration. Similarly, when fire enable controller 305 provides a second clock having a rate greater than the rate of the first clock 316, the width of the fire enable pulse decreases at each adjacent memory element of row 304 with fluid ejecting element 302*a* receiving a fire enable pulse having the longest duration and fluid ejecting element 302N receiving the fire enable pulse having the shortest duration. Thus, by varying the rate of the second clock signal provided to nTFE shift register 402 via path 328, fire enable controller 305 controls the width of the fire enable pulse of each memory element 304 to thereby control the energy delivered to the firing resistor 72 of each corresponding fluid ejecting element 302*a* to 302N.

Figure 11:
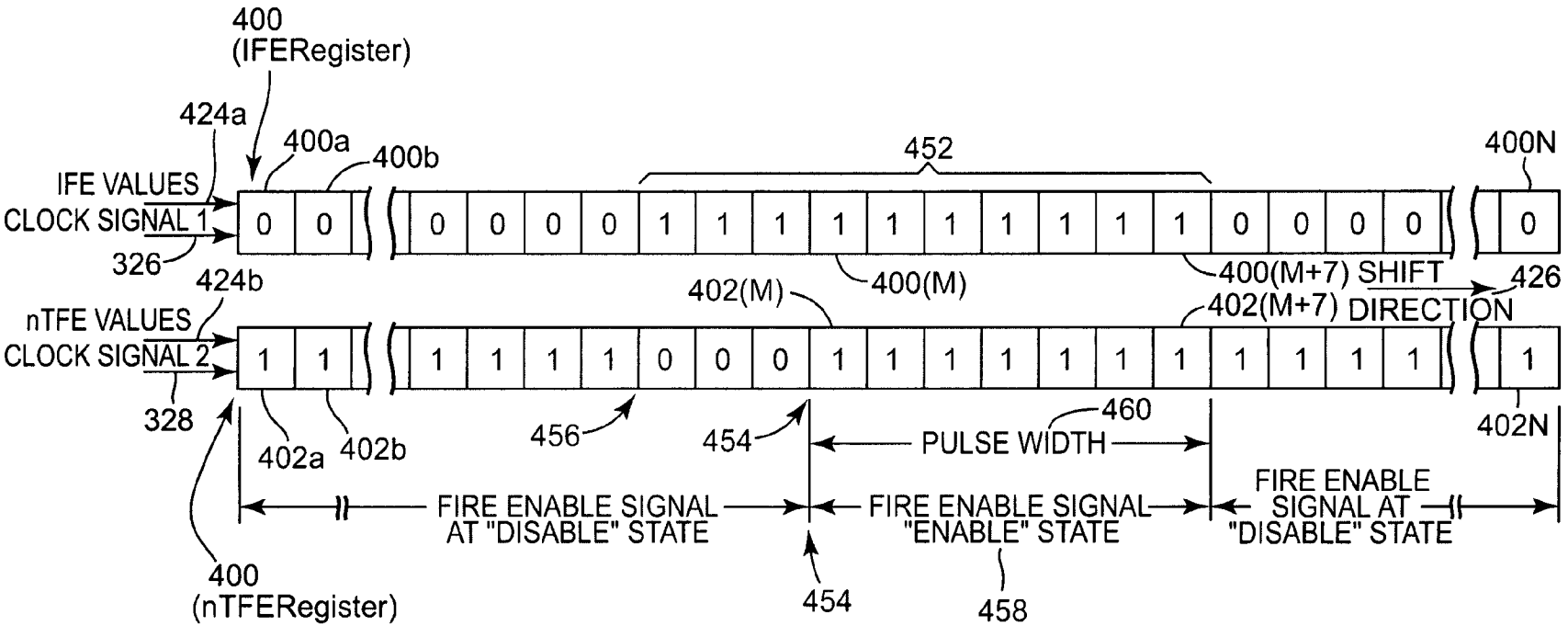
FIG. 11 is a block diagram illustrating an example operation of the printhead assembly of FIG. 10.

FIG. 11 is a block diagram illustrating an example operation of the printhead assembly 300 of FIG. 10. As described above, each memory element 400*a* to 400N of IFE shift register 400 initially holds a "0" while each memory element 402*a* to 402N of nTFE shift register 402 initially holds a "1". As illustrated by the ten adjacent memory elements 400 indicated at 452, IFE shift register 400 initially received ten IFE values having a value of "1" and is in the process of receiving N IFE values having a value "0" that will ultimately result in the initial ten IFE values being shifted through IFE shift register 400 in shift direction 426. Also, as indicated by the adjacent memory elements 402 at 454, nTFE shift register 402 began receiving nTFE values having a value of "0" after the IFE shift register 400 received seven IFE values having a value of "1". As indicated by the adjacent memory elements 402 at 456, when IFE shift register 400 began receiving IFE values having a value of "0", nTFE register 402 began receiving nTFE values having a value of "1" and will continue receiving nTFE values having a value of "1" until the nTFE values having a value of "0" are shifted through nTFE shift register 402 in shift direction 426.

At the point in time illustrated by FIG. 10, fluid ejecting elements 302 corresponding to memory elements 400(M) to 400(M+7) of IFE shift register 400 and memory elements 402(M) to 402(M+7) are receiving a fire enable signal being the enabling value, as indicated at 458. Also at this point in time, the fire enable pulse width for the fluid ejecting element 302 associated with memory elements 400(M) and 402(M) is indicated at 460 and equals the duration between memory element 400(M) receiving an IFE value having a value of "1" and memory element 402(M) receiving an nTFE value having a value of "0". As can be seen from FIG. 11, the pulse width will decrease across the array in the direction of shifting 426 when the rate of the second clock at 328 is greater than the rate of the first clock at 326. Likewise, the pulse width will increase across the array in the direction of shifting 426 when the rate of the second clock at 328 is less than the rate of the first clock at 326, wherein the pulse width can increase up to a maximum width determined by the number of consecutive "1's" at 452 being shifted through IFE register 400.

Figure 12:
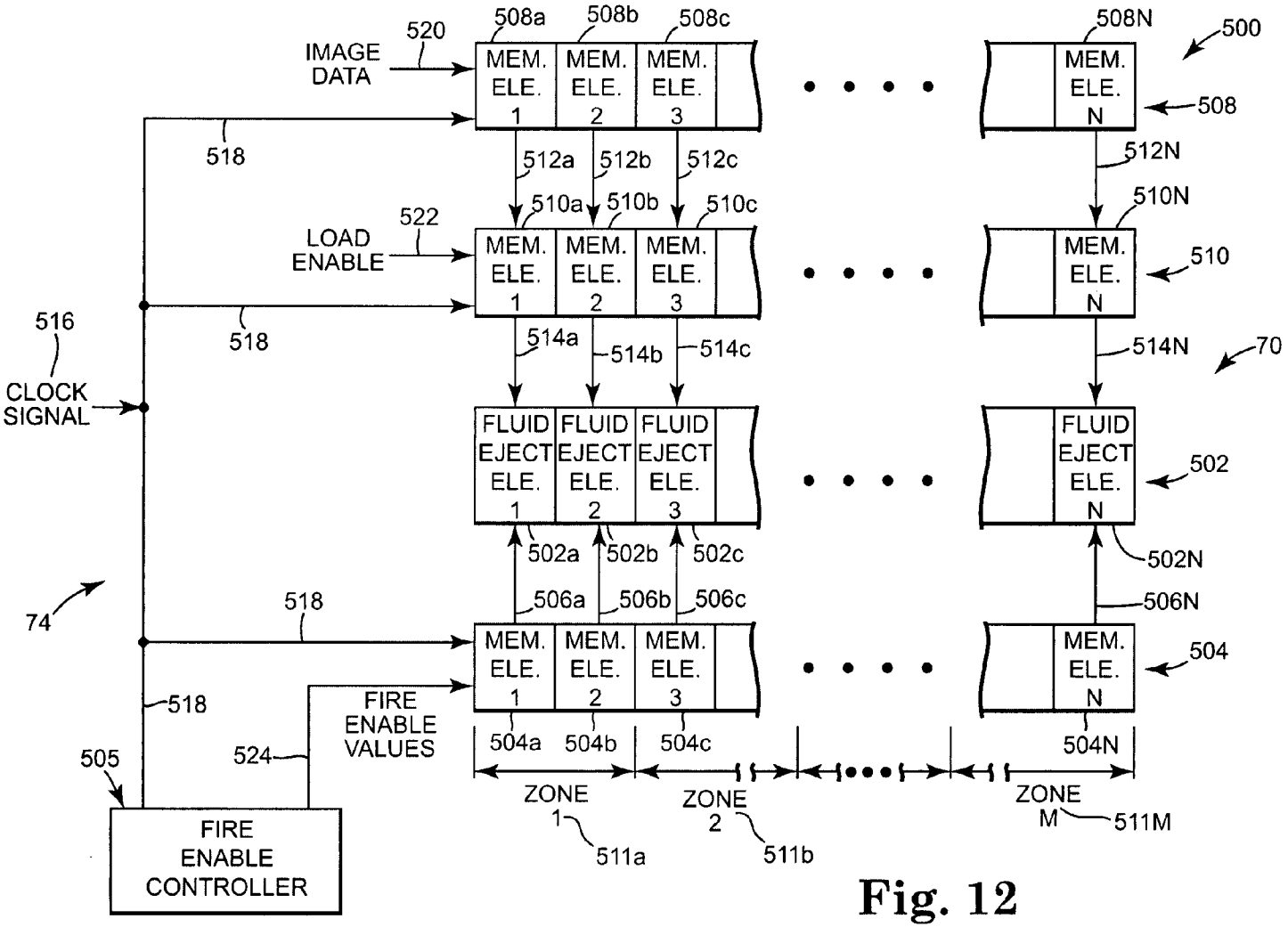
FIG. 12 is a block diagram illustrating portions of another embodiment of a printhead assembly employing registering of fire enable values for controlling energy provided to fluid ejecting elements.

FIG. 12 is a block diagram illustrating a portion of another embodiment of a printhead assembly 500 according to the present invention having drive circuitry 74 employing registering of fire enable values for controlling energy provided to fluid ejecting elements 70. In the illustrated embodiment, fluid ejecting elements 70 comprise a row 502 of N fluid ejecting elements, identified as fluid ejecting elements 502*a* to 502N. In one embodiment, row 502 comprises a row of fluid ejecting elements having a width substantially equal to a width of a print medium. Printhead assembly 500 further includes a row 504 of N fire enable memory elements, illustrated as 504*a* to 504N, a fire enable controller 505, a data input shift register 508, and a data hold shift register 510.

In the illustrated embodiment, each of the N fire enable memory elements 504*a* to 504N is coupled to a corresponding one of the N fluid ejecting elements of row 502 via paths 506*a* to 506N. Data input shift register 508 includes N one-bit memory elements, illustrated as 508*a* to 508N, and data hold shift register 510 includes N one-bit memory elements, illustrated as 510*a* to 510N. Additionally, fire enable memory elements 504*a* to 504N of row 504 are arranged into M memory element zones, identified as memory element zones 511*a* to 511M.

Each of the N one-bit memory elements of data input shift register 508 is coupled to a corresponding one of the N one-bit memory elements of data hold shift register 510 via paths 512*a* to 512N. Each of the N one-bit memory elements of data hold shift register 510 is, in-turn, coupled to a corresponding one of the N fluid ejecting elements of row 502 via paths 514*a* to 514N. Additionally, data input shift register 508, data hold shift register 510, and fire enable controller 505 each receive a clock signal 516 via a path 518 from a controller, such as controller 20 (see FIG. 1).

In one embodiment printhead assembly 500 is configured to print a row of image data comprising N bits of image data in a fashion similar to that described above for printhead assembly 100. As such, the N bits of image data are initially serially-shifted into data input shift register 508 via a path 520 from a controller, such as controller 20 (see FIG. 1), with one bit of image data being shifted upon each clock cycle of clock signal 516. Each of the N bits of image data has value of a "1" or "0", with a "1" indicating that there is image data to be printed and a "0" indicating that there is no image data to be printed. After N cycles of clock signal 516, data input shift register 508 is filled with the N bits of image data of the row, at which point data hold shift register 510 receives a load enable signal from controller 20 via a path 522 and the N bits of image data are parallel-shifted from data input shift register 508 to data hold shift register 510 via paths 512*a* to 512N.

Row 504 of fire enable memory elements 504*a* to 504N then receives fire enable values from fire enable controller 505 via path 524, with each fire enable value being one of an enabling value or a disabling value. Upon each cycle of clock signal 516, each of the fluid ejecting elements 502*a* to 502N receives the fire enable value from the corresponding fire enable memory element of row 504 and image data from the corresponding memory element of data hold shift register 510 via paths 506 and 514, respectively. Each fluid ejecting element 502*a* to 502N is configured to eject ink when the corresponding fire enable value is the enabling value and when there is image data to be printed. In other words, when the corresponding memory element of data hold shift register 510 holds image data having a value of "1", each fluid ejecting element 502 will be energized for ink ejection so long as the corresponding fire enable memory element of row 504 stores the enabling value.

Fire enable controller 505 is configured to individually control the fire enable values provided to each zone of fire enable memory elements 511*a* to 511M. By controlling the duration for which the enabling values and the disabling values of each zone are stored in each fire enable memory element 511*a* to 511M, fire enable controller 505 controls the energy provided to fluid ejecting elements 302 corresponding to each zone.

Figure 13:
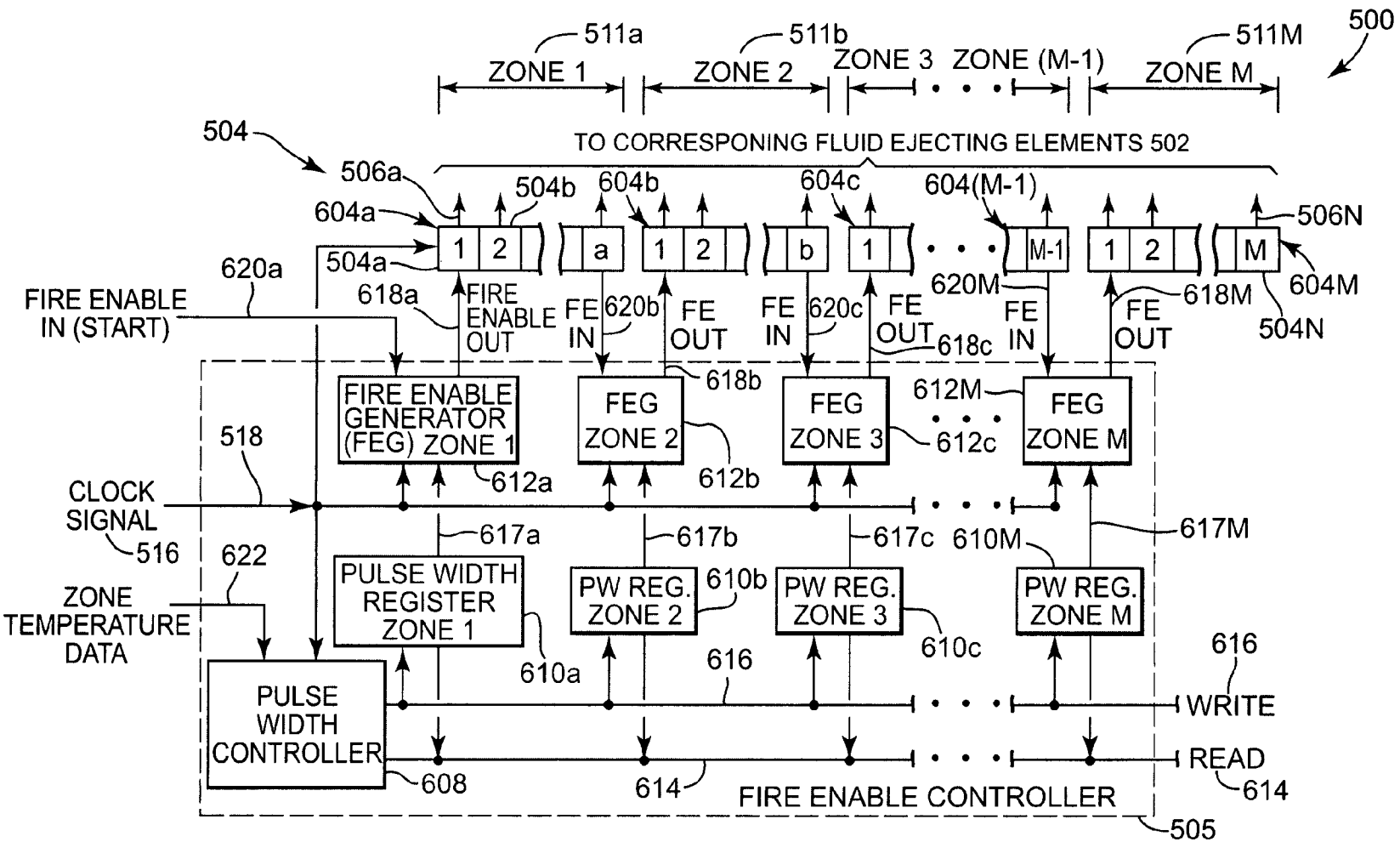
FIG. 13 is a block diagram illustrating portions of one embodiment of a fire enable controller that may be used with the printhead assembly of FIG. 12 for controlling energy provided to fluid ejecting elements.

FIG. 13 is a block diagram illustrating portions of a fire enable controller for controlling energy provided to fluid ejecting elements 70 with the printhead assembly 500 of FIG. 12. Printhead assembly 500 includes fire enable controller 505 and M fire enable zone (FEZ) shift registers, identified as shift registers 604*a* to 604M. Each of the shift registers 604*a* to 604M correspond to a different one of the memory element zones 511*a* to 511M. Each of the (FEZ) shift registers 604*a* to 604M includes a plurality of one-bit memory elements, and are configured so that, together, shift registers 604*a* to 604M form the row of N fire enable memory elements 504, with the first one-bit memory element of shift register 604*a* corresponding to fire enable memory element 504*a* and the last one-bit memory element of shift register 604M corresponding to fire enable memory element 504N. The number of one-bit memory elements may vary from register to register, but the total of one-bit memory elements of shift registers 604*a* to 604M sums to N. Additionally, each of the one-bit memory elements of FEZ shift registers 604 is coupled to a different one of the fluid ejecting elements 502, via paths 506*a* to 506N.

Fire enable controller 505 includes a pulse width controller 608, M pulse width zone registers (PWRs) 610*a* to 610M, and M fire enable zone generators (FEGs) 612*a* to 612M, with each PWR 610 and each FEG 612 corresponding to a different one of the M memory element zones 511. Each PWR 610 is coupled to a read line 614 and a write line 616 and to a corresponding FEG generator 612 via a path 617.

Each FEG 612, except for FEG 612*a*, is coupled via a path 618 to a first memory element of a corresponding FEZ shift register 604 and is coupled via a path 620 to a last memory element of a FEZ shift register 604 preceding its corresponding FEZ shift register 604. FEG 612*a* is also coupled to a first memory element of a corresponding FEZ shift register 604 (which as illustrated is the first memory element of FEZ shift register 604*a*, which corresponds to fire enable memory element 504*a*), but is coupled via path 620*a* to a controller, such as controller 20.

Printhead assembly 600 operates as described below to print a row of image stored in data hold shift register 510. Initially, each memory element of each FEZ shift register 604 contains a value of "0". A print cycle begins when FEG 612*a*, corresponding to the first memory element zone 511*a*, receives a value of "1" at the fire enable input via path 620*a*. On the next cycle of clock signal 516, FEG 612*a* begins sending fire enable values having a value of "1" to corresponding FEZ shift register 604*a* via path 618*a*, sending one fire enable value upon each cycle of clock 316.

When the first of the fire enable values having a value of "1" propagates to the last memory element of FEZ shift register 604*a* (indicated as "a"), the fire enable value is provided to the fire enable input of FEG 612*b*, corresponding to the second memory element zone 511*b*. In response, FEG 612*b* begins sending fire enable values having a value of "1" to corresponding shift register 604*b*. This process is repeated until FEG 612M, corresponding to memory element zone 511M, receives a fire enable value of "1" from the last memory element of FEZ shift register 604(M−1) via path 620M, and it too provides fire enable values having a value of "1" to its corresponding FEZ shift register 604M.

The number of clock cycles that each FEG 612 provides a fire enable value having a value of "1" is determined by its corresponding PWR 610. Each PWR 610 contains a number corresponding to the number of clock cycles that the corresponding FEG 612 is to provide a fire enable value having a value "1" for the corresponding zone of fire enable memory elements 511. The numbers are written to each PWR 610 by pulse width controller 608 via write line 616. In one embodiment, pulse width controller 608 determines the numbers based on temperature data received via a path 622 for each zone 511 from temperature sensors located in each zone. In other embodiments, the number stored in each PWR 610 is also based on a power supply voltage level, average firing resistor values associated with each zone, and prior knowledge of appropriate energy levels under similar conditions.

After each FEG 612 provides a quantity of fire enable values having a value of "1" based on the value stored in the corresponding PWR 610, each FEG provides fire enable values having a value of "0" until each memory element of the corresponding FEZ shift register 604 again holds a "0". The net effect is that a series of fire enable values having a value of "1" is clocked across fire enable memory elements 504*a* to 504N, with each zone of fire enable memory elements 511 potentially receiving a fire enable signal having a different pulse width. By controlling the number of fire enable values having a value of "1" provided to individual zones 511, printhead assembly 500 can individually control the energy provided to firing resistors 72 associated with each zone.

Temperature Control

In inkjet printheads, ink droplet weight and "decap" performance, among other things, are affected by the temperature of the printhead. Drop weight has significant temperature dependence, and variations in drop weight due to variations in printhead temperature can result in print quality defects such as varying optical densities and hues. Decap refers to a thickening of ink in the nozzle area due to evaporation of a carrier fluid, or vehicle, into the surrounding air. If a printhead is left "uncapped" at an excessively high temperature, the time may be short before the ink thickens and becomes a defect-producing nozzle obstruction.

Unfortunately, one characteristic of an array is that when in use, different sections, or zones, of an array are typically at different temperatures. These temperature variations, or thermal gradients, across the printhead can potentially produce the above described print quality defects. As a result, temperature control is a beneficial feature in inkjet printing systems, particularly in wide array inkjet printing systems where longer distances give rise to thermal gradients, to improve print quality and printhead assembly performance.

Figure 14:
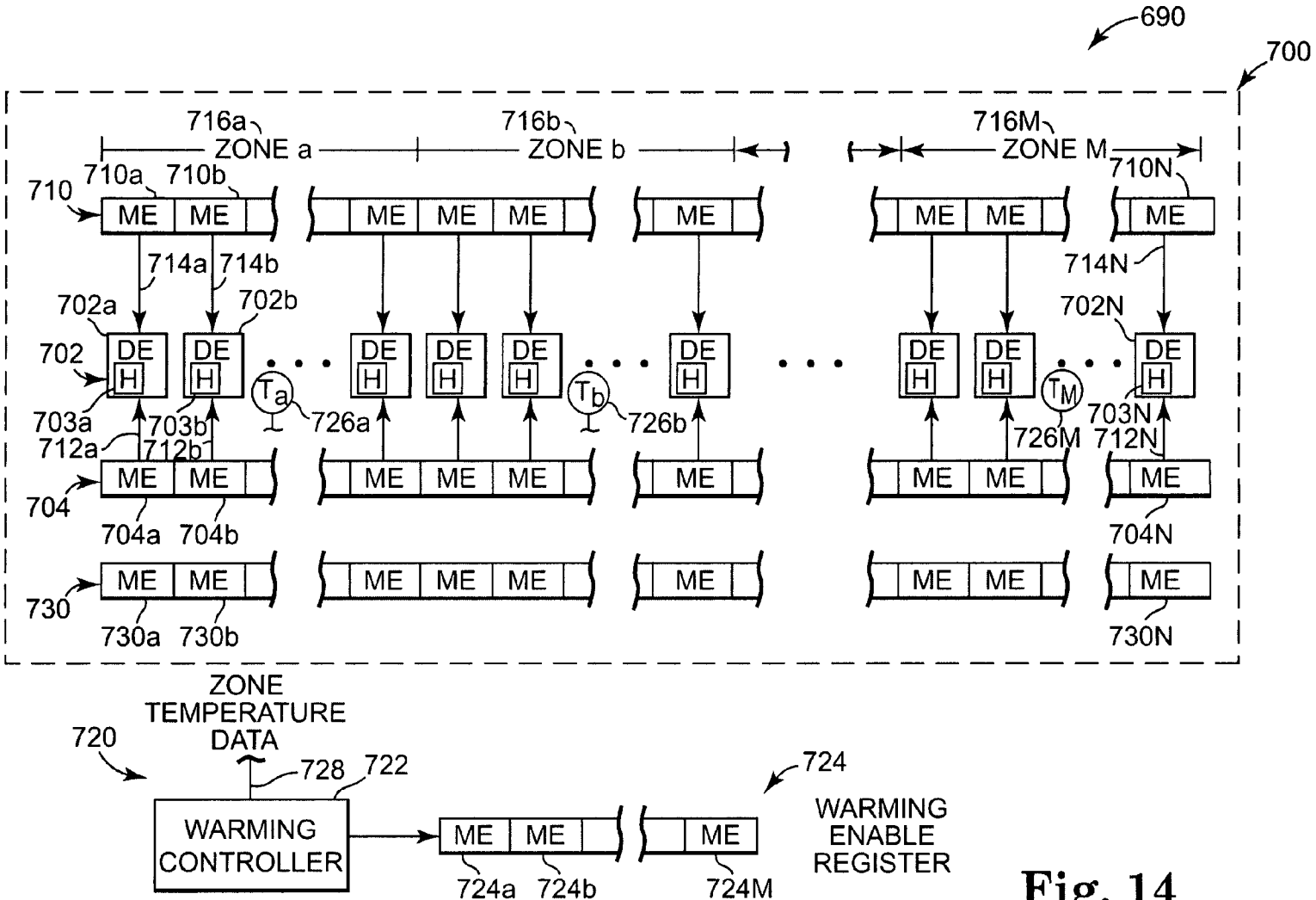
FIG. 14 is a block diagram illustrating generally portions of a printing system according to the present invention employing temperature sensing and registering of fire enable values for controlling operating temperatures of drop ejecting elements.

FIG. 14 is a block diagram illustrating generally a portion of a wide array inkjet printing system 690 according to the present invention having drive circuitry 74 employing temperature sensing and registering of fire enable values for controlling operating temperatures of drop ejecting elements 70. As illustrated, printing system 690 includes a printhead assembly 700 having drop ejecting elements 70 configured as a row 702 of N drop ejecting elements, identified as drop ejecting elements 702*a* to 702N. Each drop ejecting element 702 further includes a heater circuit 703, indicated as 703*a* to 703N. In one embodiment, row 702 has a maximum dimension, e.g. width, of a print medium that can be inserted into a printer in which the printhead is located.

Printhead assembly 700 further includes a fire enable shift register 704 having N memory elements, indicated as 704*a* to 704N, and a data hold shift register 710 having N memory elements, indicated as 710*a* to 710N. Each of the N memory elements of fire enable shift register 704 is coupled to a corresponding one of the drop ejecting elements 702 via paths 712*a* to 712N. Similarly, each of the N memory elements of data hold shift register 710 is coupled to a corresponding one of the drop ejecting elements 702 via paths 714*a* to 714N.

Drop ejecting elements 702 and corresponding memory elements 704 and 710 are arranged in a plurality of zones 716, indicated as 716*a* to 716M, with each zone having at least one drop ejecting element 702. In one embodiment, zones 716 are selected based on expected thermal gradients across the width of row 702. The number of zones 716 and the number of drop ejecting elements 702 in each zone 716 may vary, depending on the granularity of temperature control desired.

Printing system 690 further includes a warming system 720. Warming system 720 includes a warming controller 722, a warming enable register 724, and a plurality of temperature sensors 726. Warming enable register 724 comprises a plurality of memory elements, indicated as 724*a* to 724M, each corresponding to a different one of the zones 716. Each memory element 724 stores a warming enable value being an enabling value or a disabling value. In one embodiment, as illustrated, each temperature sensor of the plurality, indicated as 726*a* to 726M, comprises a portion of printhead assembly 700 and corresponds to and is located proximate to a different one of the zones 716. Each temperature sensor 726 provides temperature data representative of the operating temperature of the corresponding zone 716. In other embodiments, temperature sensors 726 can be positioned at other locations suitable for providing temperature data representative of the operating temperatures of zones 716. In one embodiment, warming system 720 comprises a portion of printhead assembly 700.

In one embodiment, printing system 690 is configured to print a row of image data comprising N bits of image data in a fashion similar to that described above for printhead assembly 200. As such, the N bits of image data are shifted into the N memory elements of data hold shift register 710. Each of the N bits of image data has a value of "1" or "0", with a "1" indicating that there is image data to be printed and a "0" indicating there is no image data to be printed.

Fire enable shift register 704 then receives a series of fire enable values from a controller, such as controller 20 (see FIG. 1), with each memory element 704*a* to 704N storing a fire enable value being one of at least one enabling value and at least one disabling value. Each drop ejecting element 702 is enabled to generate an ink droplet when the corresponding fire enable memory element 704 stores a fire enable value being an enabling value. As a result, when it's corresponding memory element of data hold shift register 710 stores an image data bit having a value of "1", each drop ejecting element 702 will generate an ink droplet.

Warming controller 722 receives, via path 728, temperature data from each of the temperature sensors 726 and monitors the operating temperature of each zone 716. When the operating temperature of a given zone 716 is below a corresponding setpoint temperature for the zone, warming controller writes a warming enable value being an enabling value to the zone's corresponding memory element in warming enable register 724. In one embodiment, when a warming enable value being an enabling value is written to a memory element 724 corresponding to a zone 716 of a drop ejecting element whose corresponding fire enable memory element 704 is storing a fire enable value being an enabling value, corresponding heater circuit 703 is activated and heats the drop ejecting element, but not to a temperature sufficient to generate an ink droplet.

In one embodiment, printhead assembly 700 optionally includes a warming control shift register 730 having N memory elements, indicated as 730*a* to 730N, with each of the N memory elements corresponding to a different one of the N drop ejecting elements 702. When printing system 690 prints a row of image data, warming control shift register 730 is configured to receive a series of warming control values from a controller in a fashion similar to that described above for fire enable shift register 704, wherein each warming control value is one of at least one enabling value or a at least one disabling value. In one embodiment, warming control shift register 730 receives the series of warming control values concurrent with fire enable shift register 704 receiving the series of fire enable values. When a warming control value which is an enabling value is stored in a memory element 730 corresponding to a drop ejecting element 702 in a zone 716 whose warming enable value stored in corresponding memory element 724 is an enabling value, the corresponding heater circuit 703 is activated and heats the drop ejecting element, but not to a temperature sufficient to generate an ink droplet.

By maintaining those drop ejecting elements 702 that are enabled to eject an ink droplet at a setpoint temperature, or baseline temperature, in this fashion, variations in the weight of ink droplets generated across the width of printhead assembly 700 are reduced, resulting in a reduction of print defects. Furthermore, by heating only those drop ejecting elements 702 in the zone 716 that is enabled, generation of excessive waste heat is reduced.

Figure 15:
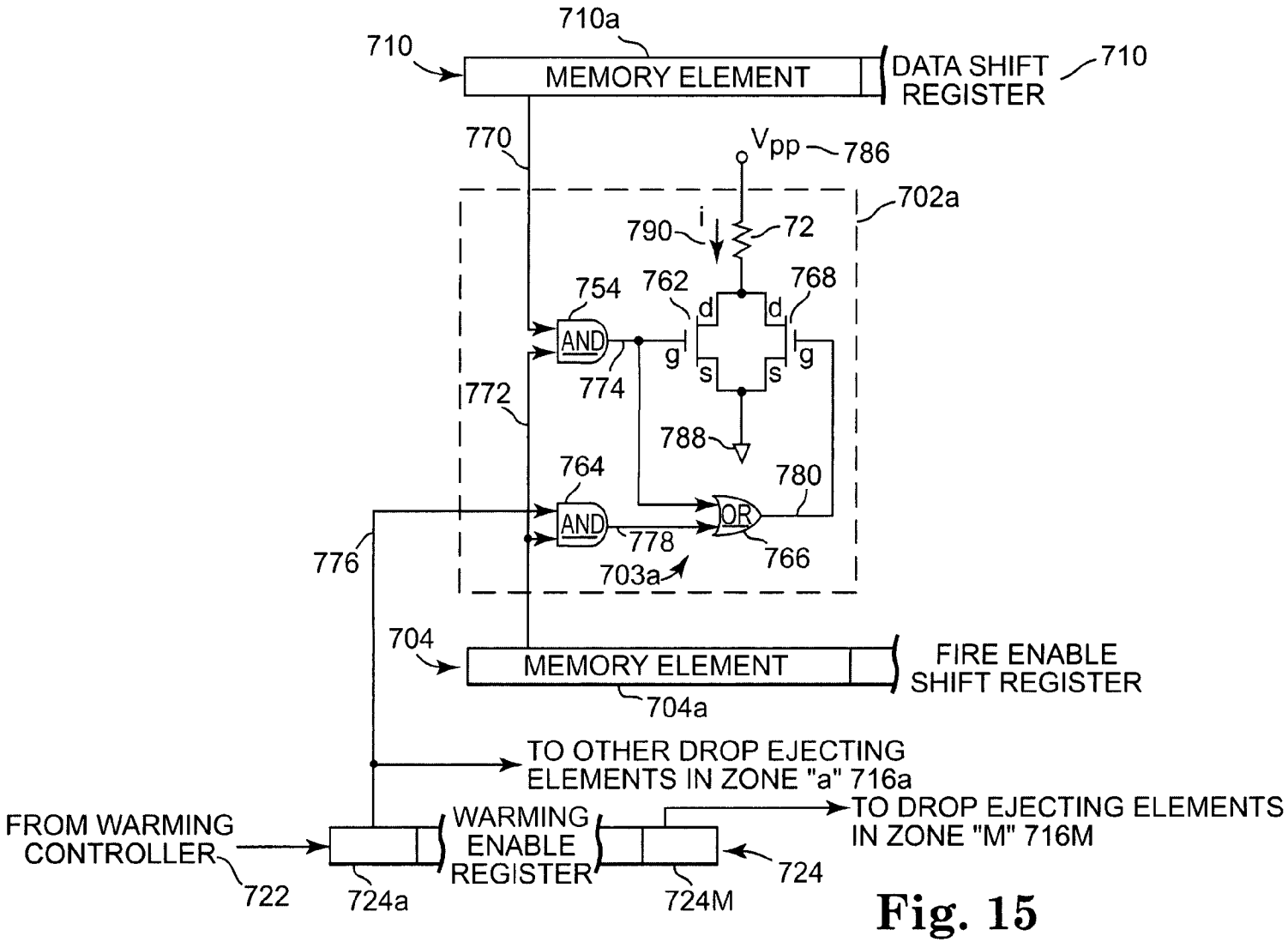
FIG. 15 is a schematic and block diagram illustrating one embodiment of a drop ejecting element according to the present invention.

FIG. 15 is a schematic and block diagram illustrating one embodiment of drive circuitry 74 for each drop ejecting element 70, for example drop ejecting element 702*a*, and includes heating circuit 703*a*. Heater circuit 703*a* includes firing resistor 72, AND-gates 754 and 764, an OR-gate 766, and field effect transistors (FET's) 762 and 768.

A first input of AND-gate 754 is coupled via a path 770 to corresponding memory element 710*a* of data shift register 710, wherein memory element 710*a* stores an image data value. In one embodiment, the image data value has a value of "1" or "0". A second input of AND-gate-754 is coupled via a path 772 to memory element 704*a* of fire enable shift register 704, wherein memory element 704*a* stores a fire enable value being one of an enabling value or a disabling value. In one embodiment, the fire enable value is an enabling value when the fire enable value is "1" and is a disabling value when the fire enable value is "0". An output of AND-gate 754 is coupled via a path 774 to a control gate of FET 762.

A first input of AND-gate 764 is coupled via a path 776 to memory element 724*a* of warming enable register 724, wherein memory element 724*a* stores a warming enable value which is one of an enabling value or a disabling value. In one embodiment, the warming enable value is the enabling value when the warming enable value is "1' and the disabling value when the warming enable value is "0". A warming enable value of "1" indicates that the temperature of corresponding zone 716*a* is below the corresponding setpoint temperature. A second input of AND-gate 764 is coupled to memory element 704*a* via path 772.

A first input of OR-gate 766 is coupled to the output of AND-gate 754 via path 774. A second input of OR-gate 766 is coupled to an output of AND-gate 764 via a path 778. An output of OR-gate 766 is coupled to a control gate of FET 768 via a path 780. Firing resistor 72 has a first terminal coupled to a voltage source (Vpp) 786 and a second terminal coupled to the drains of FET's 762 and 768. The source terminals of FET's 762 and 768 are coupled to ground 788.

Each FET 762 and 768 has a different "ON" resistance ($R_{ON}$). In one embodiment, the $R_{ON}$ of FET 762 is low relative to the $R_{ON}$ of FET 768. Consequently, FET 762 is capable of switching a higher current 790 through firing resistor 72 relative to FET 768. The $R_{ON}$ values of FET's 762 and 768 are such that the current 790 switched through firing resistor 70 by FET 768 acting independently is insufficient to cause nucleation of ink in a corresponding ink chamber, such as ink chamber 86 (See FIG. 4), and thus insufficient to cause an ink droplet to be ejected through a corresponding nozzle, such as nozzle 13. However, when FET's 762 and 768 are switched together, the equivalent RON value of FET's 762 and 768 is such that a current 790 through firing resistor 70 has a value high enough to cause nucleation of the ink and an ink droplet to be ejected from a corresponding nozzle.

When both the fire enable value and the data image value, stored respectively in memory elements 704*a* and 710*a*, have a value of "1", the output of AND-gate 754 is "high", which results in the output of OR-gate 766 being "high". With the outputs of both AND-gate 754 and OR-gate 766 being "high", both FET's 762 and 768 are turned on, resulting in drop ejecting element 702*a* generating an ink droplet, regardless of the value of the corresponding warming enable value stored in memory element 724*a*.

When the fire enable value stored in memory element 704*a* has a value of "1" but the image data stored in memory element 710*a* has a value of "0", the output of AND-gate 754 is "low". Consequently, FET 762 is turned off. If the corresponding warming enable value stored respectively in memory element 724*a* has a value of "1", the output of AND-gate 764 is "high", resulting in the output of OR-gate 766 being "high". With the output of OR-gate 766 being "high", FET 768 is turned on. With FET 768 turned on and FET 762 turned off, current 790 has a level too low to cause nucleation of ink in a corresponding ink chamber, but a level high enough to cause firing resistor 72 and FET 768 to generate enough heat to warm drop ejecting element 702*a*. If the warming enable value has a value of "0", meaning that the temperature of zone 716*a* is at or above the setpoint temperature, both FET 762 and FET 768 will be turned off and no current will pass through and no heat will be generated by firing resistor 72 or FET 768.

When both the fire enable value and the data image value, stored respective in memory elements 704*a* and 710*a*, have a value of "0", the outputs of both AND-gates 754 and 764 will be "low". Consequently, both FET's 762 and 768 will be turned off and no current will pass through and no heat will be generated by firing resistor 72, regardless of the value of the corresponding warming enable value stored in memory element 724*a*.

Figure 16:
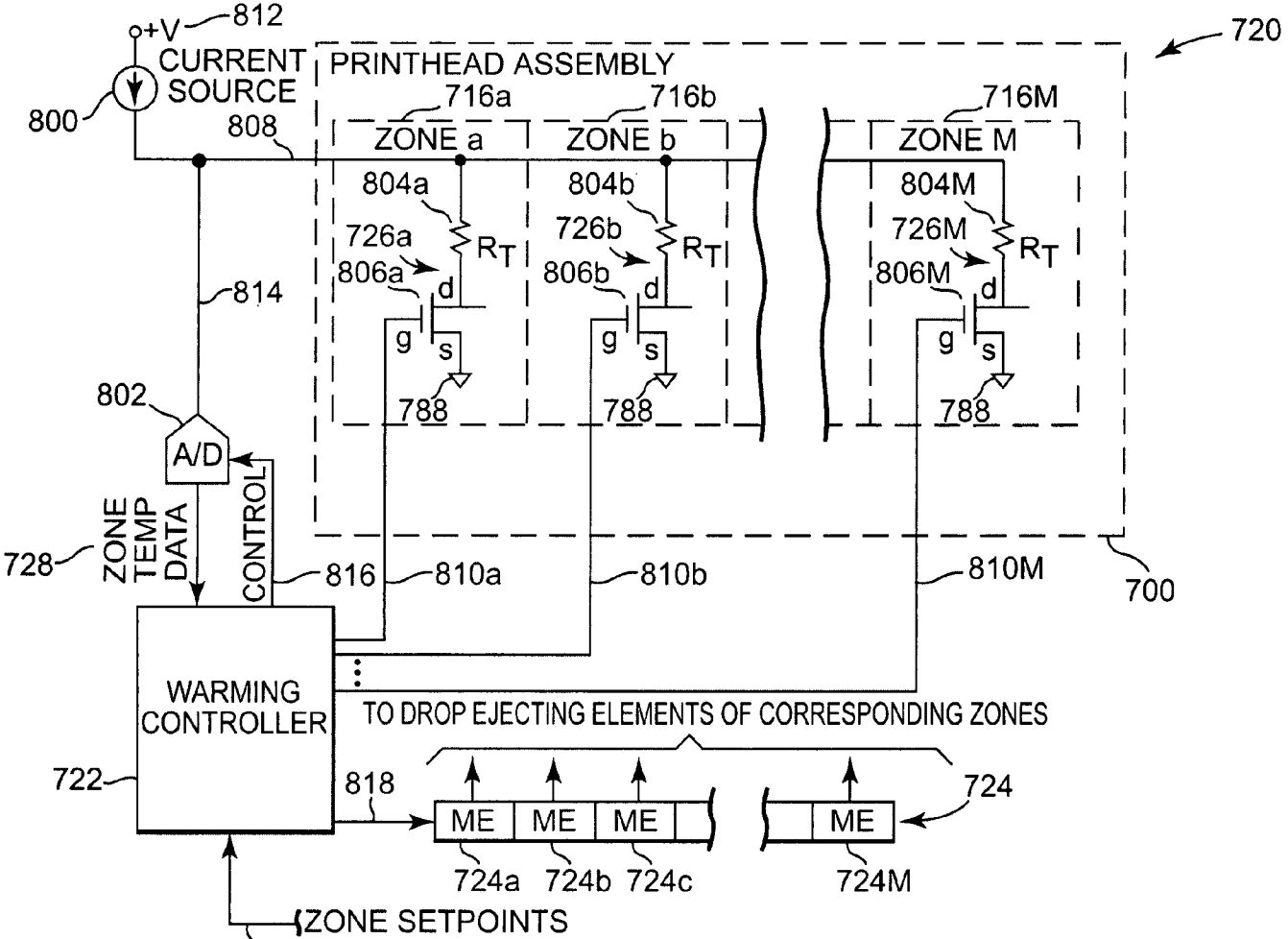
FIG. 16 is a schematic and block diagram illustrating one embodiment of a warming system according to the present invention for use with the printing system of FIGS. 14 and 15.

FIG. 16 is a schematic and block diagram illustrating a portion of one embodiment of warming system 720 according to the present invention for use with printhead assembly 700 of an inkjet printing system, such as printing system 690. Warming system 720 includes warming controller 722, warming enable register 724, temperature sensors 726, a current source 800, and an analog-to-digital (A/D) converter 802. In one embodiment, warming controller 722 and warming enable register 724 form a portion of printhead assembly 700

In one embodiment, as illustrated, warming system 720 includes a plurality of temperature sensor 726, each temperature sensor 726 of the plurality corresponding to a different one of the zones 716 of printhead assembly 700. In other embodiment, multiple temperature sensors 726 may be provided for each zone 716. In one embodiment, as illustrated, each temperature sensor 726 is located internally to printhead assembly 700 and proximate to the corresponding zone 716.

In one embodiment, as illustrated, each temperature sensor 726 includes a temperature sensitive resistor ($R_T$) 804 and a field effect transistor (FET) 806. A first terminal of each resistor $R_T$ 804 is coupled via a shared supply path 808 to current source 800, and a second terminal of each RT 804 is coupled to a drain terminal of corresponding FET 806. A control gate of each FET 806 is coupled via a corresponding switch control line 810 to warming controller 722, and a source terminal of each FET 806 is coupled to ground 788. Current source 800 is powered from a voltage source 812.

An input of A/D converter 802 is coupled to supply path 808 via a path 814 and an output is coupled to warming controller 722 via path 728. Warming controller 722 is further coupled to a control input of A/D converter 802 via a path 816. Warming controller 722 provides warming control data (i.e., warming enable values) to warming enable register 724 via a path 818, and receives via a path 820 setpoint temperature data for each zone 716 from a controller, such as controller 20.

Prior to printing image data, warming controller 722 sequentially measures the present temperature of each zone 716 by sequentially turning on FET's 806*a* to 806M via their corresponding switch control lines 810*a* to 810M. When a given FET 806 is turned on, it completes a current path from current source 800 to ground 788 via path 808 and the corresponding $R_T$ 804, with current source 800 providing a current at a known level. The resulting voltage level generated at the input of A/D converter 802 via path 814 is a function of the current provided by current source and the resistance of $R_T$ 804 corresponding to the given zone (neglecting the resistance of corresponding FET 806), and is proportional to the present temperature of the given zone. A voltage reading of each zone 716 is taken by A/D converter 802 and provided to warming controller 722 via path 728.

During manufacture, readings of initial voltage values are taken for each zone 716 at a known reference temperature for calibration purposes by warming controller 722 and stored therein. These initial voltage values and known characteristic of $R_T$ 804 are used by warming controller 722 to convert the present voltage readings received via path 728 to a present temperature value for each zone 716.

Warming controller 722 then compares the present temperature value of each zone 716 to a desired setpoint temperature value for each zone previously received at 820 from a system controller, such as controller 20. Warming controller then compares the present temperature value of each zone 716 to the zone's corresponding desired setpoint temperature value, and writes a warming enable value having a value based on the comparison to the corresponding memory element of warming enable register 724. The warming enable value will be an enabling value (i.e., a value of "1") when the present temperature level is less than the desired setpoint temperature value, and a disabling value (i.e., a value of "0") when the present temperature level is at least equal to the desired setpoint temperature level. The warming enable values of each memory element of warming enable register 724 are then provided to drop ejecting elements 702 of the corresponding zone 716 for activation of heating circuits 703 as described above by FIGS. 14 and 15.

Figure 17:
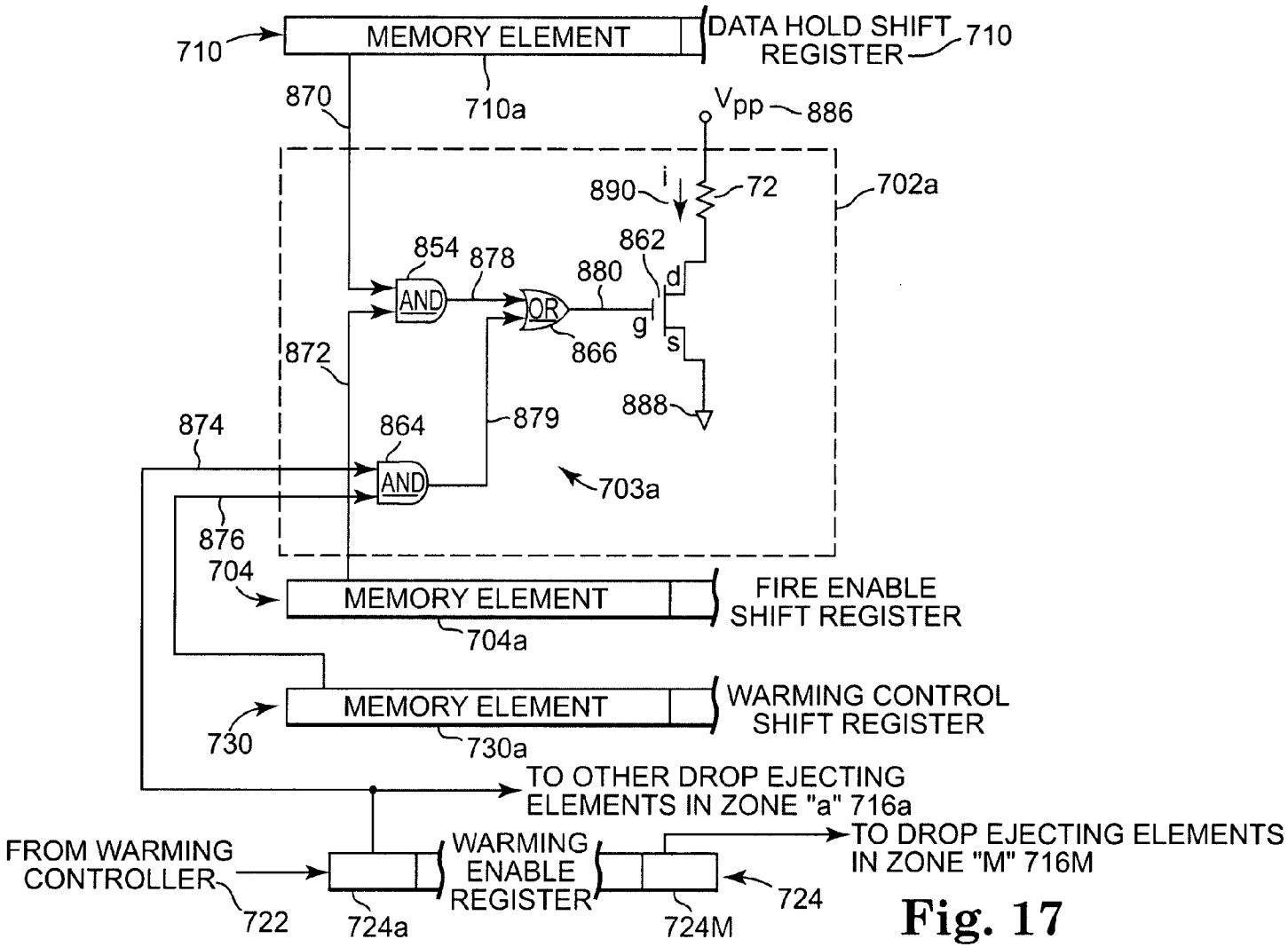
FIG. 17 is a schematic and block diagram illustrating one embodiment of a drop ejecting element according to the present invention.

FIG. 17 is a schematic and block diagram illustrating one embodiment of drive circuitry 74 for each drop ejecting element 70, for example drop ejecting element 702*a*, and includes heating circuit 703*a*. Heater circuit 703*a* includes firing resistor 72, a field effect transistors (FET) 862, AND-gates 854 and 864, and an OR-gate 866.

A first input of AND-gate 854 is coupled via a path 870 to corresponding memory element 710*a* of data hold shift register 710, wherein memory element 710*a* stores an image data value having a value of "1" or "0". A second input of AND-gate 854 is coupled via a path 872 to memory element 704*a* of fire enable shift register 704, wherein memory element 704*a* stores a fire enable value being one of an enabling value or a disabling value. In one embodiment, the fire enable value is the enabling value when the fire enable value is "1" and the disabling value when the fire enable value is "0".

A first input of AND-gate 864 is coupled via a path 874 to memory element 724*a* of warming enable register 724, wherein memory element 724*a* stores a warming enable value being one of an enabling value or a disabling value. In one embodiment, the warming enable value is the enabling value when the warming enable value is "1" and the disabling value when the warming enable value is "0". A warming enable value of "1" indicates that the temperature of corresponding zone 716*a* is below the corresponding setpoint temperature. A second input of AND-gate 864 is coupled via a path 876 to memory element 730*a* of warming control shift register 730, wherein memory element 730*a* stores a warming control value being one of an enabling value or a disabling value. In one embodiment, the warming control value is the enabling value when the warming control value is "1" and the disabling value when the warming control value is "0".

A first input of OR-gate 866 is coupled via a path 878 to an output of AND-gate 854. A second input of OR-gate 866 is coupled via a path 878 to an output of AND-gate 864. An output of OR-gate 866 is coupled via a path 880 to a control gate of FET 862. Firing resistor 72 has a first terminal coupled to a voltage source ($V_{PP}$) 886 and a second terminal coupled to a drain of FET 862. A source terminal of FET 862 is coupled to ground 888.

To print a row of image data stored in data shift register 710, a series of fire enable values having a value of "1" (enabling value) are shifted through fire enable shift register 704, wherein each memory element of fire enable shift register 704 initially stored a value of "0" (disabling value). If memory element 710*a* of data shift register 710 is holding an image data value of "1", both inputs to AND-gate 854 will be "high" as the series of fire enable values having a value of "1" are shifted through memory element 704*a*. With both inputs of AND-gate 854 "high", the output will also be "high" and cause the output of OR-gate 866 to be "high". With the output of OR-gate 866 "high", FET 862 is turned on, causing a current 890 to flow through firing resistor 72 to ground 888.

The period of time that current 890 flows through firing resistor 72 depends on the number of "1's" in the series of fire enable values having the enable state that are shifted through fire enable shift register 704. In any case, the minimum number of "1's" in the series is sufficient to cause current 890 to flow long enough for firing resistor 72 to generate enough heat to cause nucleation of ink and an ink droplet to be ejected from a corresponding nozzle. If memory element 710*a* is holding an image data value of "0", no ink droplet will be ejected from the corresponding nozzle regardless of the series of fire enable values is the enabling value.

Concurrently with the series of "1 's" being shifted across fire enable shift register 704, a series of warming control value having a value of "1" (enabling value) is shifted through warming control shift register 730, wherein each memory element of warming control shift register 730 initially stored a value of "0" (disabling value). If memory element 724*a* of warming enable register 724 is holding a warming enable value of "1" (meaning that the temperature of zone 716*a* is below the setpoint temperature), both inputs to AND-gate 864 will be "high" as the series of warming control values having a value of "1" is shifted through memory element 730*a*. With both input of AND-gate 864 "high", the output will also be "high" and cause the output of OR-gate 866 to be "high." With the output of OR-gate 866 "high", FET 862 is turned on, causing current 890 to flow through firing resistor 72 to ground 888.

The period of time that current 890 flows through firing resistor 72 depends on the number of "1's" in the series of warming control values (i.e., being enabling values) that are shifted through warming control shift register 730. As described above, a given consecutive number of fire enable values having a value of "1's" is required to cause firing resistor 72 to generate heat sufficient to cause nucleation of ink and ejection of an ink droplet. Thus, a maximum allowable number of "1's" in the series of warming control values will be sufficient to cause current 890 to flow long enough to heat drop ejecting element 702, but not long enough for firing resistor 72 to generate enough heat to cause nucleation of ink, and thus no ink droplet to be ejected from the corresponding nozzle.

In one embodiment, drop ejecting elements 702 are warmed by heating circuit 703 independent of whether printhead assembly 690 is printing image data. In this case, the series of warming control values having a value of "1" is shifted through warming control shift register 730 with no image data stored in data shift register 710 and no series of fire enable values being enabling values being shifted through fire enable shift register 704. When the temperature of zone 716*a* is below the setpoint temperature, warming controller 722 will write a memory enable value having a value of "1" in memory element 704*a*. As the series of warming control values having a value of "1" is shifted through warming control shift register 730, and thus through memory element 730*a*, both inputs to AND-gate 864 will be "high", thereby causing the output of OR-gate 866 to be "high" and FET 862 to be turned on.

With FET 862 turned on, current 890 is conducted through firing resistor 72 and begins to warm drop ejecting element 702*a*. The series of warming control elements having a value of "1" is continued to be shifted through fire enable shift register 730 and memory element 730*a* until the temperature of zone 716*a* reaches the setpoint temperature. When the temperature of zone 716*a* reaches the setpoint temperature, warming controller 722 ceases the warming of drop ejecting elements in the zone by writing a warming enable value having a value of zero to memory element 724*a*, thereby causing the outputs of AND-gate 864 and OR-gate 866 to go low and FET 862 to turn off.

It should be noted that while the description uses "1" to indicate enabling values, and "0" to indicate disabling values, the reverse can be utilized depending on the logic used.

Further, even though a shift register is shown in each of the figures that extends for an entire row of fluid ejection elements, multiple shift registers that each relate to different portions of a row of fluid ejection elements may be utilized. By using multiple shift registers that relate to different portions of a single row, a single row of fluid ejection elements may have different portions that eject fluid simultaneously. This allows for an increase in the fluid ejection speed of a row, which has advantages in the area of printing.

Also, it should be noted that a single row, in one embodiment has a 600 dpi resolution, and as such in one implementation, the number of nozzles in a row should allow for such resolution. However, other resolutions and numbers of nozzles may be utilized depending on the needs and particular applications.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device comprising:

a first shift register including a first set of N memory elements serially receiving a series of fire enable values, each fire enable value including one of an enabling value or a disabling value;

a second shift register including a second set of N memory elements serially receiving N image data sub-blocks of an image data block, each image data sub-block including one of an enabling value or a disabling value;

a third shift register including a third set of N memory elements receiving in parallel the N image data sub-blocks from the second set of N memory elements of the second shift register and holding the N image data sub-blocks; and N fluid ejecting elements each receiving the fire enable value from a corresponding one of the first set of N memory elements of the first shift register and the image data sub-block from a corresponding one of the third set of N memory elements of the third shift register, wherein one of the fluid ejecting elements is enabled to eject a fluid when the fire enable value and the image data sub-block each are the enabling value.

2. The fluid ejection device of claim 1, wherein the first set of N memory elements of the first shift register and each of the N fluid ejecting elements are formed on a thin-film structure formed on a substrate including a non-conductive material selected from a group consisting of an oxide formed on a metal, a carbon composite material, a ceramic material, and glass.

3. The fluid ejection device of claim 1, wherein the N fluid ejecting elements are configured as a row that extends substantially for a width of a page of print media.

4. The fluid ejection device of claim 1, wherein the image data block comprises a row of image data and each image data sub-block comprises a bit of image data.

5. The fluid ejection device of claim 1, wherein the third set of N memory elements of the third shift register is configured to receive the image data block from the second set of N memory elements of the second shift register in response to a load enable signal.

6. The fluid ejection device of claim 1, wherein after the third set of N memory elements of the third shift register receives the N image data sub-blocks from the second set of N memory elements of the second shift register, the second set of N memory elements of the second shift resister is configured to serially receive and store N image data sub-blocks of a next image data block.

7. The fluid ejection device of claim 1, wherein each of the N fluid ejecting elements is configured to receive upon each cycle of a clock the image data sub-block from the corresponding one of the third set of N memory elements of the third shift register.

8. The fluid ejection device of claim 1, wherein the one of the fluid ejecting elements is not enabled to eject the fluid when one of the fire enable value or the image data sub-block is the disabling value.

9. The fluid ejection device of claim 1, wherein the N fluid ejecting elements are configured to print a block of image data in a print cycle, wherein the first set of N memory elements of the first shift register is configured to serially receive in the print cycle a series of fire enable values representative of a fire enable pulse, and wherein the first set of N memory elements of the first shift register receives a fire enable value upon each cycle of the clock, with a first fire enable value of the series being received upon a first clock cycle of the print cycle and a last fire enable value of the series being received upon a last clock cycle of the print cycle.

10. The fluid ejection device of claim 9, wherein a first X fire enable values of the series received during a first X clock cycles of the print cycle are enabling values and a remaining N fire enable values of the series received during a remaining N clock cycles of the print cycle are disabling values such that the enabling values propagate through the first set of N memory elements of the first shift register in a print cycle, wherein at an end of the print cycle each of the N memory elements of the first set of N memory elements of the first shift register is storing the disabling value.

11. The fluid ejection device of claim 10, wherein a product of X multiplied by a duration of the clock cycle substantially equals an enable pulse duration.

12. The fluid ejection device of claim 1, wherein each of the N fluid ejecting elements comprises:

a logic element configured to receive the fire enable value from the corresponding one of the first set of N memory elements of the first shift register and the image data sub-block from the corresponding one of the third set of N memory elements of the third shift register, and to provide a power switch control signal having a first state when the fire enable value and the image data sub-block each are the enabling value;

a heater resistor having a first terminal connectable to a power source and a second terminal; and a switch coupled between the second terminal of the heater resistor and ground, the switch configured to receive the power switch control signal and connect the second terminal of the heater resistor to ground when the power switch control signal has the first state.

13. The fluid ejection device of claim 12, wherein the switch comprises:

a field effect transistor having a gate coupled to the logic element, a drain coupled to the second terminal of the heater resistor, and a source coupled to ground.

14. The fluid ejection device of claim 12, wherein the logic element comprises:

an AND-gate having a first input coupled to the corresponding one of the first set of N memory elements of the first shift register, a second input coupled to the corresponding one of the third set of N memory elements of the third shift register, and an output providing the power switch control signal.

15. A fluid ejection device comprising:

a fire enable shift register including a series of N memory elements configured to serially receive and serially transfer a series of fire enable values through the series of N memory elements;

a data input shift register including a first set of N memory elements configured to serially receive N image data bits of a row of image data;

a data hold shift register including a second set of N memory elements configured to receive in parallel the N image data bits from the first set of N memory elements and hold the N image data bits; and N fluid ejecting elements each coupled to and configured to receive one of the fire enable values from a different one of the series of N memory elements, and coupled to and configured to receive one of the image data bits from a different one of the second set of N memory elements, wherein each fluid ejecting element is enabled to eject a fluid when the one of the fire enable values and the one of the image data bits each are an enabling value.

16. The fluid ejection device of claim 15, wherein the series of N memory elements and each of the N fluid ejecting elements are formed on a thin-film structure formed on a substrate including a non-conductive material selected from a group consisting of an oxide formed on a metal, a carbon composite material, a ceramic material, and glass.

17. The fluid ejection device of claim 15, wherein each of the N memory elements of the second set of N memory elements corresponds to a different one of the N memory elements of the first set of N memory elements, wherein the second set of N memory elements is configured to receive a present row of image data from the first set of N memory elements in response to a load enable signal, and wherein the first set of N memory elements is configured to serially receive a next row of image data after providing the present row of image data to the second set of N memory elements.

18. The fluid ejection device of claim 15, wherein each of the N fluid ejecting elements corresponds to a different one of the N memory elements of the second set of N memory elements and is configured to receive upon each cycle of a clock the image data bit from a corresponding one of the N memory elements, wherein the fluid ejecting element does not eject the fluid when either the one of the fire enable values or the image data bit is a disabling value.

19. The fluid ejection device of claim 15, wherein the N fluid ejecting elements are configured to print the row of image data in a print cycle.

20. The fluid ejection device of claim 19, wherein the series of N memory elements is configured to serially receive during the print cycle a fire enable pulse comprising a series of the fire enable values, wherein the series of N memory elements receives one fire enable value of the series upon each cycle of the clock.

21. A method of enabling N fluid ejecting elements of a fluid ejection device, the method comprising:

serially receiving image data values in each of N memory elements of a data input shift register, each memory element of the data input shift register corresponding to a different one of N memory elements of a data hold shift register;

parallel shifting the image data values from the N memory elements of the data input shift register to the N memory elements of the data hold shift register and holding the image data values in the N memory elements of the data hold shift register, each memory element of the data hold shift register corresponding to a different one of the N fluid ejecting elements, each image data value being one of an enabling value or a disabling value;

serially receiving fire enable values in each of N memory elements of a fire enable shift register, each memory element of the fire enable shift register corresponding to a different one of the N fluid ejecting elements, each fire enable value being one of an enabling value or a disabling value;

updating the fire enable value in each of the N memory elements of the fire enable shift register with a fire enable value from an adjacent memory element upon each cycle of a clock; and upon each cycle of the clock, providing to each of the N fluid ejecting elements the fire enable value from the corresponding memory element of the fire enable shift register and the image data value from the corresponding memory element of the data hold shift register, wherein a fluid ejecting element is enabled to eject a drop of fluid when the fire enable value and the image data value each are the enabling value.

22. The method of claim 21, further comprising:

receiving serially in a print cycle at the fire enable shift register a series of fire enable values representative of a fire enable pulse, wherein the fire enable shift register receives a fire enable value upon each clock cycle of the print cycle with a first enable value of the series being received upon a first clock cycle of the print cycle and a last fire enable value of the series being received upon a last clock cycle of the print cycle.

23. The method of claim 22, further comprising:

a first X fire enable values of the series being enabling values during a first X clock cycles of the print cycle and a remaining N fire enable values of the series having a disabling value during a remaining N clock cycles of the print cycle such that the first X fire enable values being enabling values propagate through the N memory elements of the fire enable shift register in a print cycle thereby sequentially enabling each of the N fluid ejecting elements to eject a drop of fluid for a duration substantially equal to a product of X multiplied by a duration of a clock cycle.

* * * * *

UNITED STATES PATENT AND TRADEMARK OFFICE

CERTIFICATE OF CORRECTION

PATENT NO. : 7,240,981 B2
APPLICATION NO. : 10/788808
DATED : July 10, 2007
INVENTOR(S) : John Wade et al.

It is certified that error appears in the above-identified patent and that said Letters Patent is hereby corrected as shown below:

In column 25, line 65, in Claim 6, delete “resister” and insert -- register --, therefor.

Signed and Sealed this

Nineteenth Day of August, 2008

JON W. DUDAS
*Director of the United States Patent and Trademark Office*